US005339141A

United States Patent [19]

Suzuki et al.

[11] Patent Number: 5,339,141

[45] Date of Patent: Aug. 16, 1994

[54] DEVELOPING DEVICE WITH A DEVELOPER CARRIER CAPABLE OF FORMING NUMEROUS MICROFIELDS THEREON

[75] Inventors: Koji Suzuki, Yokohama; Yuichi Ueno, Kawasaki; Katsuhiro Aoki, Yokohama; Naoki Iwata, Tokyo; Akira Sawada, Yokohama; Takatsugu Fujishiro, Tokyo, all of Japan

[73] Assignee: Ricoh Company, Ltd., Tokyo, Japan

[21] Appl. No.: 18,258

[22] Filed: Feb. 16, 1993

[30] Foreign Application Priority Data

| | | | |
|---|---|---|---|
| Feb. 16, 1992 | [JP] | Japan | 4-061113 |
| Feb. 17, 1992 | [JP] | Japan | 4-061148 |
| Feb. 17, 1992 | [JP] | Japan | 4-061149 |
| Feb. 17, 1992 | [JP] | Japan | 4-061150 |
| Jul. 20, 1992 | [JP] | Japan | 4-215635 |
| Jul. 27, 1992 | [JP] | Japan | 4-220777 |

[51] Int. Cl.[5] ..... G03G 21/00

[52] U.S. Cl. ..... 355/246; 118/651; 118/653; 118/656; 355/259

[58] Field of Search ..... 355/245, 246, 251, 253, 355/259, 261, 262; 118/651, 653, 656–658, 647, 648; 430/120, 122

[56] References Cited

U.S. PATENT DOCUMENTS

| | | | |
|---|---|---|---|
| 4,295,443 | 10/1981 | Kohyama | 118/657 |
| 4,515,106 | 5/1985 | Kohyama | 118/651 |
| 4,576,463 | 3/1986 | Sakamoto et al. | 118/657 X |
| 5,172,169 | 12/1992 | Takashima et al. | 355/246 |
| 5,220,383 | 6/1993 | Enoki et al. | 355/246 |
| 5,239,344 | 8/1993 | Enoki et al. | 355/259 |
| 5,245,391 | 9/1993 | Suzuki et al. | 355/246 |

*Primary Examiner*—A. T. Grimley
*Assistant Examiner*—William J. Royer
*Attorney, Agent, or Firm*—Oblon, Spivak, McClelland, Maier & Neustadt

[57] ABSTRACT

A developing device applicable to an electrophotographic copier, facsimile transceiver, laser printer or similar image forming apparatus and having a developing roller for carrying a nonmagnetic single component type developer, i.e., a toner and a toner supply roller for supplying the toner to the developing roller. The developing roller has dielectric portions and conductive portions each having a small area and distributed together on the surface thereof. The conductive portions are connected to ground and have a volume resistivity of $10^6$ Ωcm or below. The toner supply roller is made up of a metallic core and an elastic foam layer provided on the core and having conductivity and a predetermined frictional charging characteristic. A potential difference is set up between the developing roller and the toner supply roller to generate electric fields which act on a frictionally charged toner as a force directed from the toner supply roller toward the developing roller. Micropores existing in the surface of the toner supply roller have a depth and a size selected in such a manner as not to disturb microfields formed by frictional charges deposited on the dielectric portions. The two different kinds of electric fields exist together to enhance the supply of charged toner. To eliminate leaks between the two rollers, one of the rollers is semiconductive while the other roller is conductive, and use is made of a toner whose resistance is greater than predetermined one.

45 Claims, 18 Drawing Sheets

DEVELOPING DEVICE WITH A DEVELOPER CARRIER CAPABLE OF FORMING NUMEROUS MICROFIELDS THEREON

BACKGROUND OF THE INVENTION

The present invention relates to a developing device applicable to a copier, facsimile transceiver, printer or similar image forming apparatus and using a single component type developer, i.e., a toner. More particularly, the present invention is concerned with a developing device having a developer carrier capable of forming numerous microfields thereon.

With an image forming apparatus of the type forming a latent image electrostatically on an image carrier and developing it by a developer, it is advantageous to use a developing device operable with a single component type developer, i.e., a toner from the size, cost and reliability standpoint. Particularly, a developing device using a nonmagnetic toner is advantageously applicable to a color image forming apparatus since such a toner is extremely clear. A conventional developing device operable with the toner has a developer carrier for transporting the toner along a predetermined circulation path including a developing region, storing means for storing the toner, and developer supplying means for supplying the toner to the developer carrier, as disclosed in, for example, Japanese Patent Laid-Open Publication Nos. 42672/1986 and 238072/1986.

In a developing system using a nonmagnetic toner, for example, an optimum amount of toner deposition on the developer carrier and an optimum charge to be deposited on the toner are as follows. Preferably, the toner should be deposited on the developer carrier such that the amount of toner is about 0.6 mg/cm$^2$ to 1.0 mg/cm$^2$ as measured on the developer carrier or about 0.5 mg/cm$^2$ to 0.7 mg/cm$^2$ as measured on a recording medium. The amounts of toner deposition on the image carrier and recording medium are effected not only by the amount of toner deposited on the developer carrier, but also by the relative speed of the image carrier and developer carrier as measured in the developing region.

However, the problem with this type of conventional developing device is that the toner is deposited only in a single layer on the developer carrier. Hence, although the toner transported to the developing region carries a mean charge of 5 $\mu$c/g to 15 $\mu$c/g, the amount of toner deposition on the developer carrier is as small as 0.2 mg/cm$^2$ to 0.8 mg/cm$^2$. It follows that the desired amount of toner deposition on, for example, the image carrier is not achievable unless the developer carrier is moved at a speed two to four times as high as the speed of the image carrier.

Assume that the rotation speed of the developer carrier is increased to compensate for the short toner deposition on the developer carrier. Then, it is difficult to increase the image forming speed. Moreover, when a solid image is reproduced, the density becomes higher at the trailing edge portion of the image than at the other portion. This occurrence does not matter in the case of a black-and-white image. However, in the case of a color image, the density increases at the trailing edge portion of the image since the color is recognized through the toner. Particularly, when a plurality of color components are combined to form a composite color image, the resulting colors will appear different from expected ones.

To eliminate the above-mentioned local increase in image density and deposit a desired amount of toner on, for example, the image carrier, it is necessary to bring the speed of the developer carrier close to that of the image carrier, i.e., to execute substantially equispeed development. At the same time, it is necessary to deposit a greater amount of toner on the developer carrier than conventional. Specifically, in order that the toner may be deposited in a sufficient amount on the image carrier and recording medium by the equispeed development, the prerequisite is that the toner be deposited on the developer carrier in an amount of at least 0.8 mg/cm$^2$ for contact development which is efficient or in an amount of at least 1.0 mg/cm$^2$ for noncontact development which is less efficient. This in turn requires the toner to form two or more layers on the developer carrier. Moreover, should uncharged toner particles and inversely charged toner particles exist in the toner layer on the developer carrier, they would obstruct the transfer of the toner, contaminate the background of an image, and lower the resolution. It is, therefore, preferable that the toner be deposited with a charge of 5 $\mu$c/g to 10 $\mu$c/g in mean value. In addition, the toner charge distribution should be stable, i.e., a minimum of toner particles of relatively low charge should be included in the toner which would lower the sharpness and resolution and contaminate the background.

As stated above, how to form two or more toner layers containing no uncharged particles and inversely charged particles and having a stable charge distribution of 5 $\mu$c/g to 10 $\mu$c/g on the developer carrier is the key to the equispeed development which increases the image forming speed and eliminates the local increase in image density.

Japanese Patent Application No. 15110/1990 corresponding to U.S. Ser. No. 07/597,881 filed Oct. 12, 1990 discloses a developing device including a developer carrier having fine dielectric portions and fine conductive portions distributed either regularly or irregularly on the surface thereof. The conductive portions are connected to ground. A developer supply member is rotatable at a position where it contacts the surface of the developer carrier. A single component type developer or toner is frictionally charged by the developer carrier and developer supply member. At the same time, the developer supply member and developer charge the dielectric portions by friction so as to form a great number of microfields in the vicinity of the surface of the developer carrier. As a result, the frictionally charged toner is retained on the developer carrier in multiple layers by the microfields. With this developing device, it is possible to form multiple toner layers having a stable charge distribution on the developer carrier. The present invention constitutes a further improvement over such a developing device.

SUMMARY OF THE INVENTION

It is, therefore, an object of the present invention to provide a developing device operable with a single component type developer and capable of forming multiple toner layers containing a minimum of uncharged particles and inversely charged particles and having a desirable charge distribution on a developer carrier.

In accordance with the present invention, a developing device for developing a latent image electrostatically formed on an image carrier by a developer constituted by a single component comprises a developer carrier for selectively holding a charge on the surface thereof to form a great number of microfields to thereby carry the developer and supply it to the image carrier, and a developer supply device for frictionally charging the developer to cause it to deposit on the developer carrier. The developer supply device comprises a charging member for selectively charging the surface of the developer carrier to thereby form the microfields, and an electrode member applied with a predetermined potential and facing the surface of the developer carrier while being spaced apart by a gap sufficient to maintain the microfields. The electrode member forms around the microfields electric fields which exert an electrostatic force on the frictionally charged developer toward the surface of the developer carrier. A transport member transports the frictionally charged developer to the surface of the developer carrier on which the electric fields and the microfields are formed.

Also, in accordance with the present invention, a developing device comprises a developer carrier having fine conductive portions and fine dielectric portions connected to ground regularly or irregularly distributed on a surface thereof for carrying a developer on the surface and transporting the developer to a position where the developer carrier faces an image carrier, a charging member for forming a great number of microfields on the surface of the developer carrier in frictional contact with the surface, a developer supply member facing the surface of the developer carrier while being spaced apart by a predetermined gap for supplying the developer to the surface where the microfields are formed, and a charging member for charging the developer deposited on the developer supply member.

Further, a developing device for developing an electrostatic latent image by a developer constituted by a single component of the present invention comprises a developer carrier having fine dielectric portions and fine conductive portions connected to ground regularly or irregularly distributed on the surface thereof, a storing section for storing the developer, a transport member for transporting the developer from the storing section to the surface of the developer carrier, a frictional charging member for charging the developer by friction, a charging member for depositing a predetermined charge on the dielectric portions for forming microfields on the surface of the developer carrier, and a rotary body having a predetermined resistance and rotatable at a position where the rotatable body contacts the surface of the developer carrier. The rotary body is formed with a great number of micropores in the surface thereof whose depth does not disturb the microfields even when facing the surface of the developer carrier. A power supply sets up a potential difference between the rotary body and the conductive portions to thereby generate electric fields which exert on the frictionally charged developer an electrostatic force directed from the rotary body toward the surface of the developer carrier. One of the conductive portions and rotary body is semiconductive while the other is conductive. The developer has an intrinsic volume resistivity which prevents dielectric breakdown from occurring despite the electric fields generated by the power supply.

In a preferred embodiment, at least the surface of the rotary body is made of a material intermediate between materials constituting the dielectric portions and developer with respect to a frictional charge sequence. The charging member and frictional charging member are constituted by the surface of the rotary body.

In another preferred embodiment, the charging member and frictional charging member deposit charges of the same polarity.

In another preferred embodiment, the conductive portions have a volume resistivity of $10^6$ Ωcm or below while the charging member and frictional charging member deposit charges of the same polarity.

In another preferred embodiment, the conductive portions have a volume resistivity of $10^6$ Ωcm or below. The charging member deposits on the dielectric portions and conductive portions a charge of a polarity opposite to a polarity to which the frictional charging member frictionally charges the developer.

In still another preferred embodiment the developer has a volume resistivity of less than $10^{13}$ Ωcm.

In a further preferred embodiment the rotary body is used as the transport member.

BRIEF DESCRIPTION OF THE DRAWINGS

The above and other objects, features and advantages of the present invention will become more apparent from the following detailed description taken with the accompanying drawings in which.

DESCRIPTION OF THE PREFERRED EMBODIMENTS

Figure 2A:
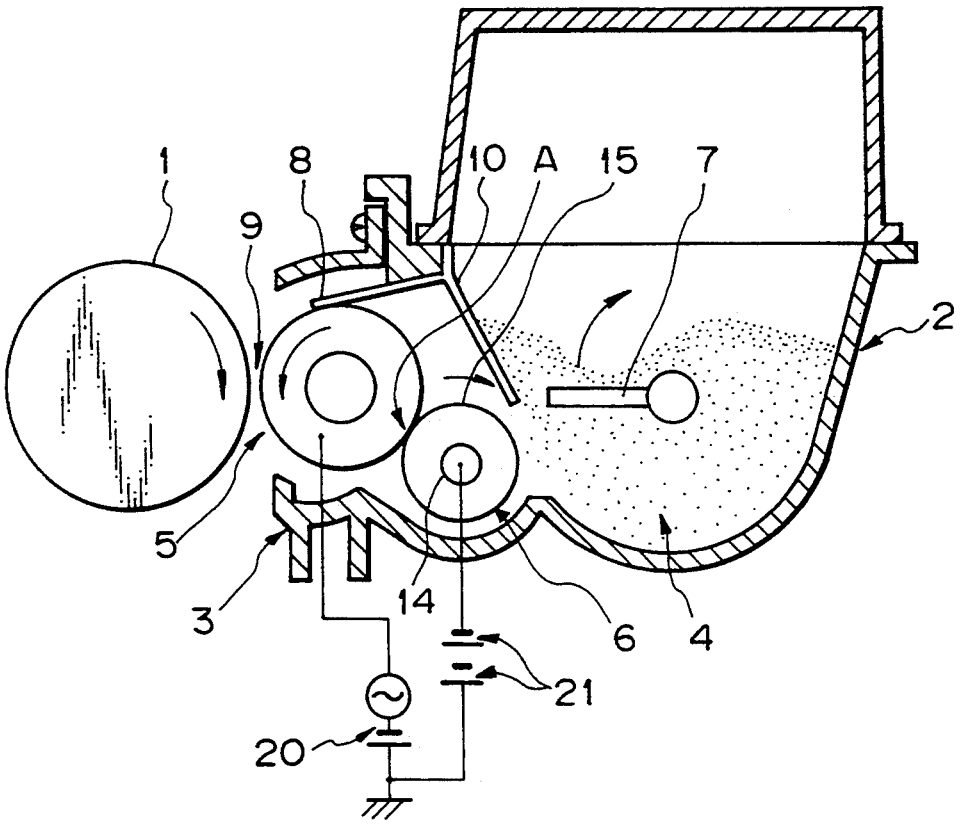
FIG. 2A is a section showing the embodiment of the invention.
Figure 2B:
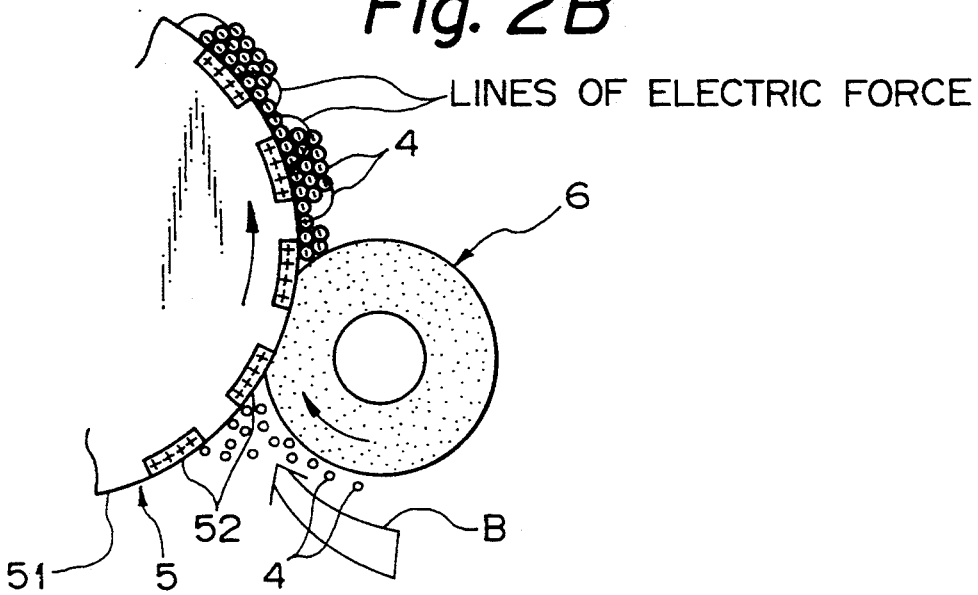
FIG. 2B is a fragmentary enlarged section of the embodiment.

Referring to FIG. 2A of the drawings, a developing device embodying the present invention is shown. As shown, an image carrier is implemented as a photoconductive drum 1 which is rotatable clockwise, as viewed in the figure, at a peripheral speed of, for example, 120 mm/sec. The developing device, generally 2, is located at the right-hand side of the drum 1. Arranged around the drum 1 are a charging device, optics for exposure, image transfer and paper separation device, cleaning device and a discharging device which are conventional electrophotographic process units, although not shown in the figure.

The developing device 2 has a casing 3 having an opening which faces the surface of the drum 1. A developer carrier implemented as a developing roller 5 is disposed in the casing 3 and rotatable counterclockwise, as viewed in the figure, at a predetermined peripheral speed while partly showing itself through the opening of the casing 3. A toner supply roller, or developer supplying means, 6 is pressed against a right portion of the developing roller 5 and rotatable clockwise, as viewed in the figure. A nonmagnetic single component type developer, i.e., a toner 4 is stored in a hopper or developer storing means which is contiguous with the right end of the casing 3. An agitator 7 supplies the toner 4 from the hopper to the toner supply roller 6 while agitating it. A partition 10 prevents the toner in the hopper from directly reaching the neighborhood of the developing roller 5. A blade 8 regulates the thickness of a toner layer formed on the developing roller 5 to be transported to a developing region 9 where the roller 5 faces the drum 1.

Figure 6:
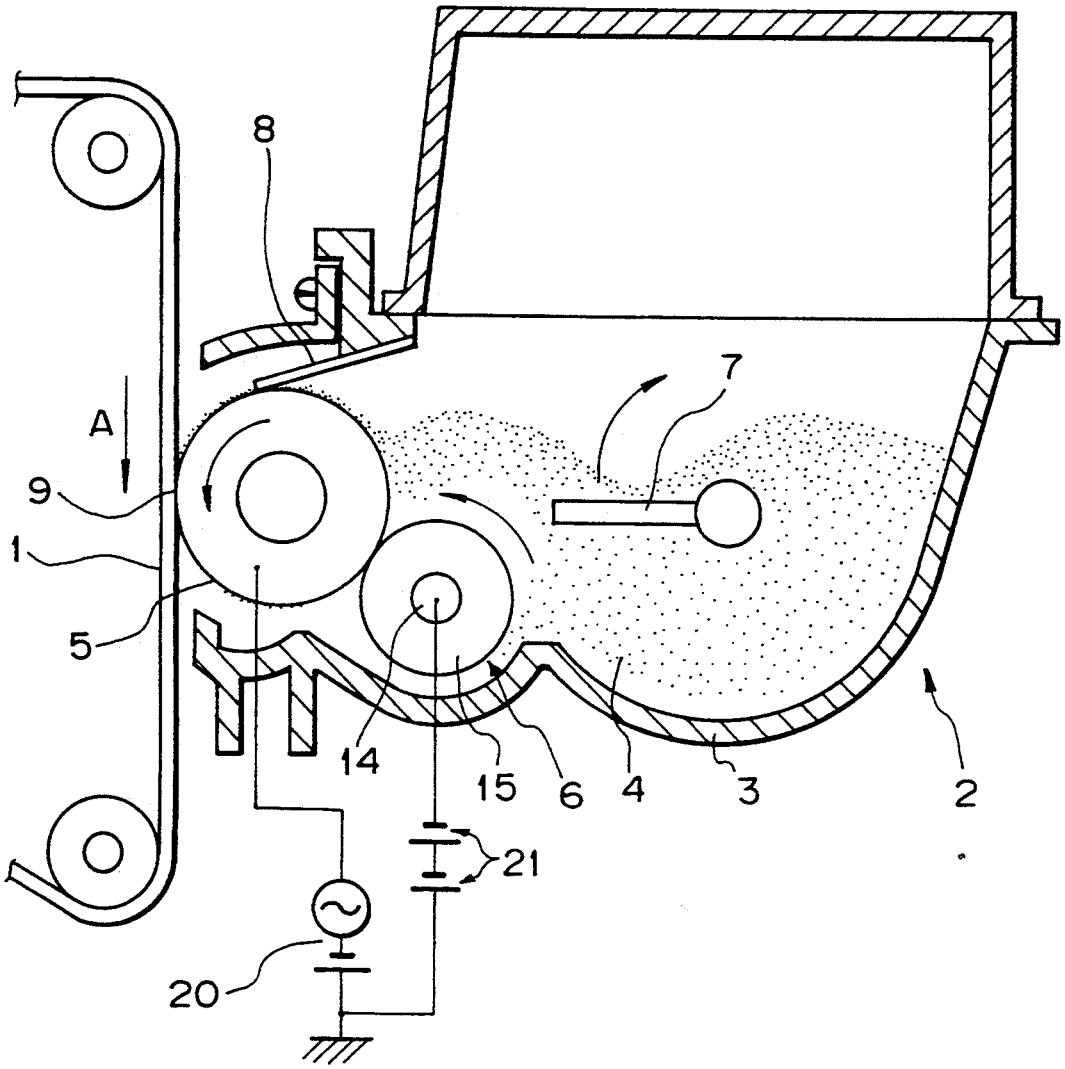
FIG. 6 is a section showing the embodiment implemented with a photoconductive element in the form of a belt.
Figure 7:
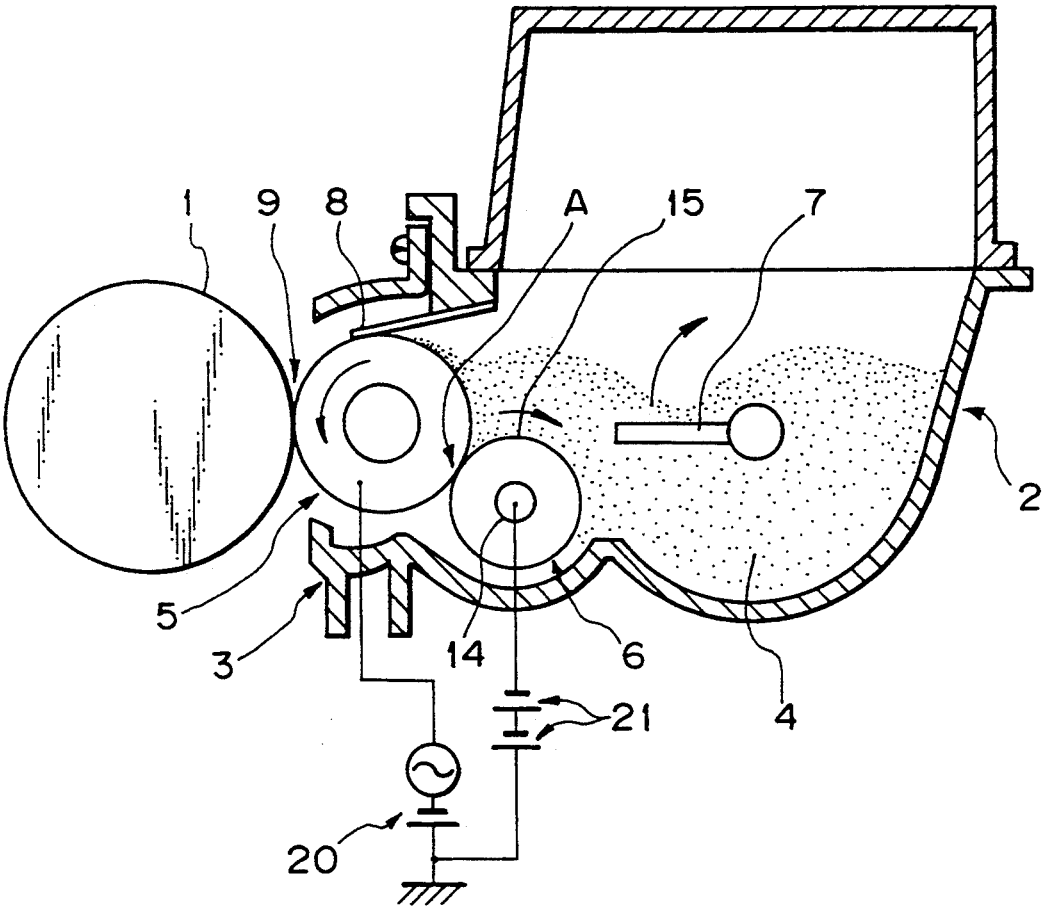
FIG. 7 is a section showing the embodiment implemented with a photoconductive element in the form of a drum.

As shown in FIG. 2A, the developing roller 5 may be spaced apart from the drum 1 by a predetermined gap at the developing region 9 so as to effect noncontact development. Alternatively, as shown in FIG. 6 or 7, the toner layer on the developing roller 5 may contact the drum 1 to effect contact development. In FIG. 6, the photoconductive element 1 is implemented as a belt. In any case, to prevent the previously discussed local increase in image density, the developing roller 5 is rotated such that in the developing region the surface of the roller 5 moves in the same direction as the surface of the drum 1 and at substantially the same peripheral speed as the drum 1, i.e., at about 120 mm/sec in the embodiment. Specifically, in the case of contact development, if the roller 5 and drum 1 move at exactly the same speed, the toner is physically apt to deposit on the drum 1 with no regard to the surface potential of the drum 1. To eliminate this, the peripheral speed of the roller 5 is selected to be slightly higher than that of the drum 1. For example, it is preferable that the ratio of the peripheral speed of the drum 1 to that of the roller 5 be 1:1.05 to 1:1.1. Such a ratio makes the above-mentioned local increased in image density inconspicuous. A power source 20 applies an adequate bias for development to the developing roller 5, e.g., a bias optimal for the flight of the toner in the case of noncontact development.

Figure 3A:
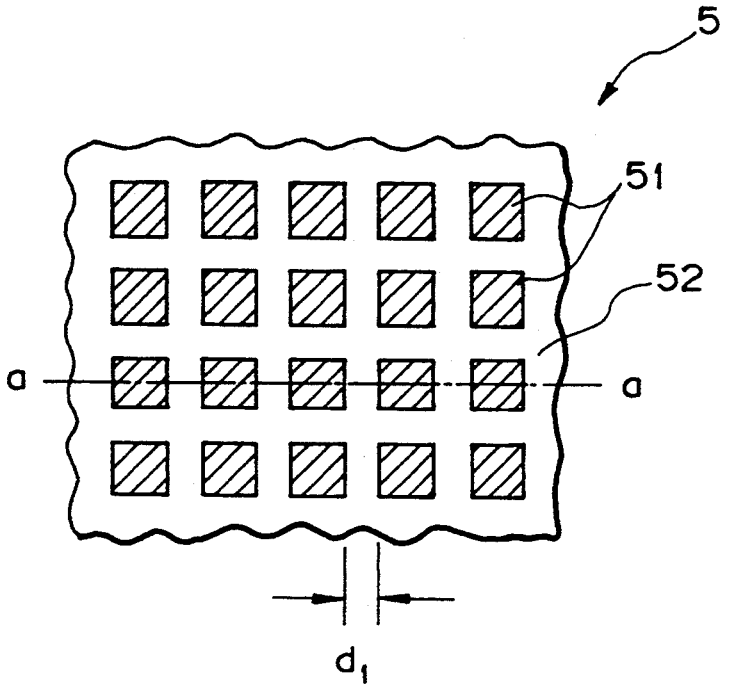
FIG. 3A is a fragmentary plan view of a developing roller included in the embodiment.
Figure 3B:
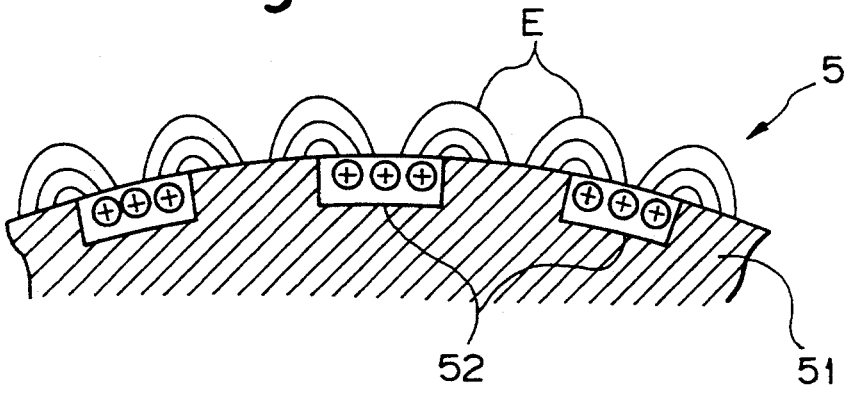
FIG. 3B is a section along line a—a of FIG. 3A.

In the illustrative embodiment, the developing roller 5 is configured to selectively hold a charge on the surface thereof. Specifically, as shown in FIGS. 3A and 3B, dielectric portions 52 capable of holding a charge and conductive portions 51 connected to ground are distributed together on the surface of the roller 5. The dielectric portions 52 and conductive portions 51 each has an extremely small area. The dielectric portions 52 are made of a dielectric material having a resistance of, for example, higher than $10^{13}$ Ωcm. Each dielectric portion 52 has a diameter of about 40 μm as measured on the surface of the roller 5 and a dimension perpendicular to the surface of the roller 5, i.e., a depth of about 50 μm to about 150 μm. The dielectric portions 52 with such dimensions are distributed either regularly or irregularly on the surface of the roller 5. The shape of the dielectric portions 52 is open to choice so long as they occupy 30% to 70%, preferably 40% to 60%, of the total area of the two portions 51 and 52.

A specific procedure for producing the developing roller 5 having the two portions 51 and 52 on the surface thereof is as follows. A metallic roller is formed with grooves in, for example, checkers on the surface thereof by knurling. Then, the knurled surface of the roller is coated with a predetermined dielectric material to form a dielectric layer. Subsequently, the surface of the roller is machined to cause the metallic core to appear on the surface as the conductive portions 51. On the other hand, the resin filled in the grooves appears on the surface of the roller as the dielectric portions 52. Alternatively, the roller 5 may have a surface layer implemented as a conductive resinous layer in which dielectric particles whose particle size ranges from 50 μm to 500 μm are dispersed, the particles appearing on the surface of the roller 5. This kind of roller 5 may be produced by coating a metallic roller with a conductive resinous material in which the dielectric particles are disposed, and then grinding the surface of the resulting surface layer.

Figure 8A:
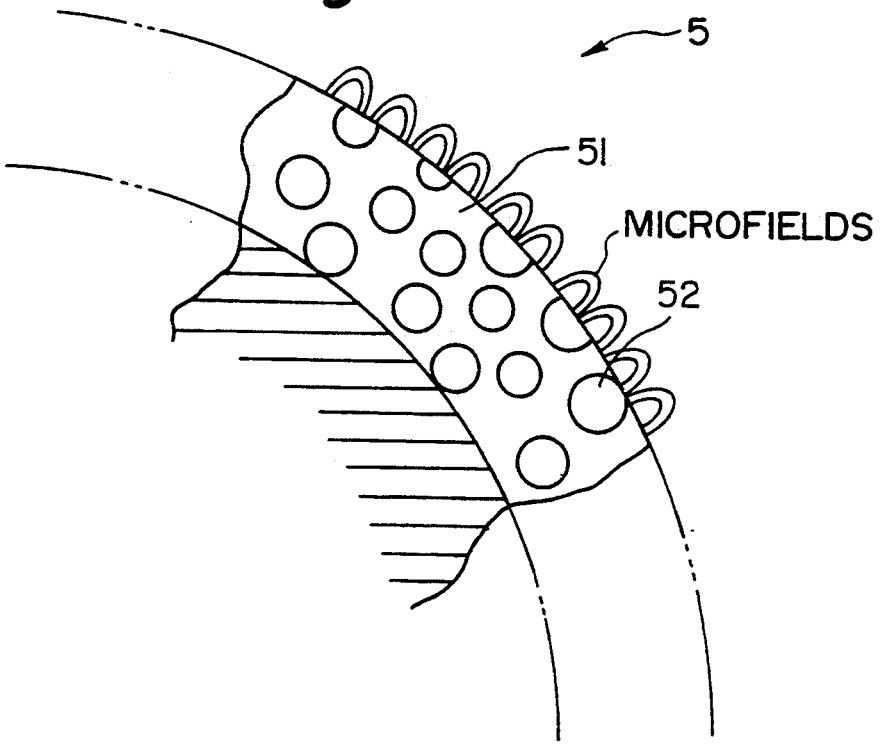
FIG. 8A is a section showing a modified form of the developing roller.
Figure 8B:
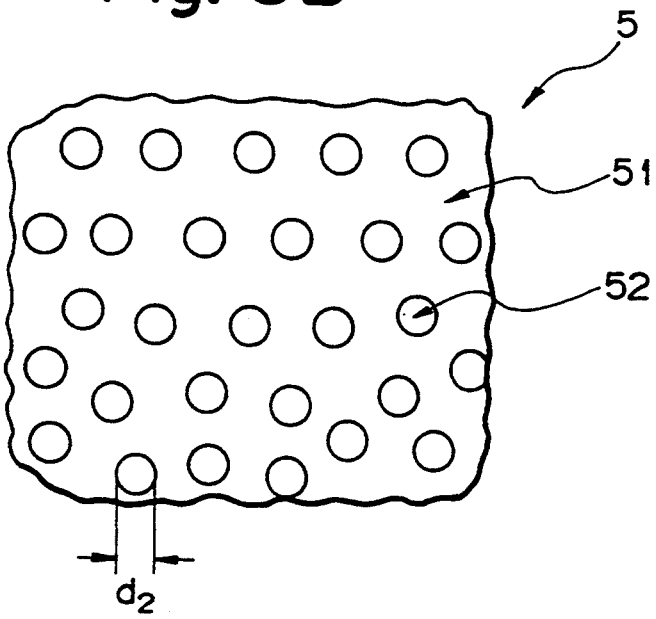
FIG. 8B is a fragmentary plan view of the developing roller shown in FIG. 8A.

FIGS. 8A and 8B show the developing roller 5 implemented with the conductive resinous layer in which the dielectric particles are dispersed as stated above. When the toner is to be charged to negative polarity by friction, the dielectric particles may be comprised of acryl particles or polyamide particles while the conductive resin may be comprised of acryl resin or urethane resin in which carbon black is dispersed. Other various resins are also available depending on the expected charge polarity of the toner.

Figure 9:
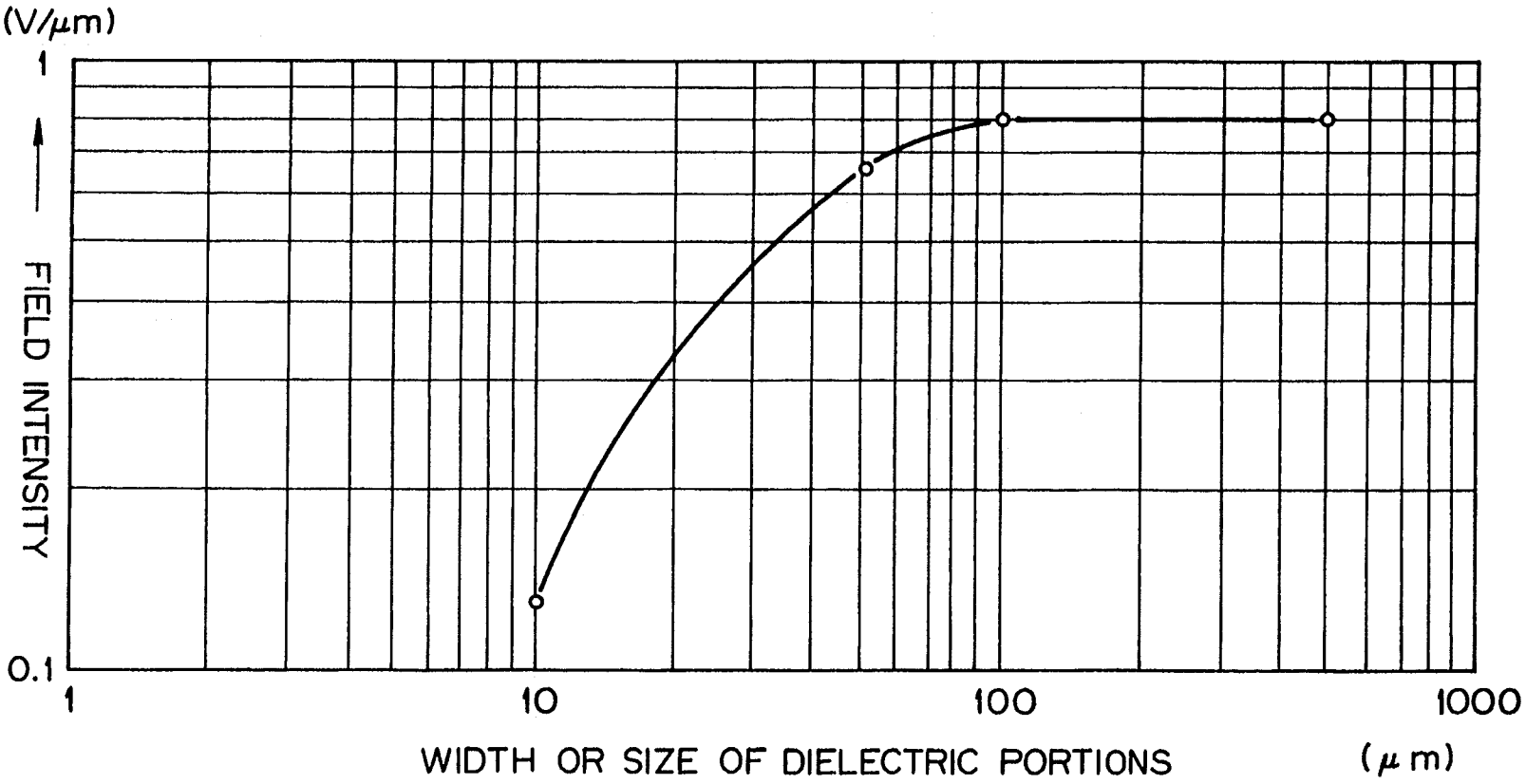
FIG. 9 plots a characteristic of the developing roller.

FIG. 9 plots a relation between the size of the dielectric particles and the intensity of electric fields to be formed on the surface of the developing roller 1. As shown, if the particle size is 50 μm or above, an electric field whose intensity is 0.7 V/μm and high enough to retain the toner is achievable. The maximum particle size is limited for imaging and roller technology reasons; the upper limit as measured on the surface of the roller 5 is about 500 μm. Regarding the imaging reason, since the toner deposition on the roller 5 depends on the electric field, great particles would cause the toner to deposit only sparsely to thereby aggravate the irregular density distribution. The maximum depthwise dimension of the particles (direction perpendicular to the roller surface) is limited to about 50 μm to 200 μm by, among others, the roller technology.

As shown in FIG. 7, when contact development is effected using a hard photoconductive drum, the developing roller 5 should preferably be implemented as a soft roller whose hardness is 30 degrees to 70 degrees in the JIS (Japanese Industrial Standard) scale as measured from the surface. Such a roller 5 may have a base and an elastic surface layer provided on the base and constituted by an elastic conductive material in which dielectric particles are dispersed. For example, the dielectric material may be comprised of a conductive elastomer having dielectric particles dispersed therein, the dielectric particles appearing on the surface of the roller 5. Specifically, the elastic conductive material may be selected from diene-based rubber, olefin-based rubber, and ether-based rubber while the dielectric particles may be selected from epoxy resins, acryl resins and polystyrene resins having a resistance of $1\times10^{12}$ Ωcm or above.

When the elastic developing roller 5 is held in contact with the hard drum 1, the gap between them can be maintained with ease. In addition, this kind of arrangement is advantageous in respect of the accuracy of the roller 5.

Preferably, the conductive portions 51 of the developing roller 5 are provided with a volume resistivity of $10^6$ Ωcm or below so as to efficiently form microfields which will be described. Alternatively, the conductive portions 51 may be made of the same material as the dielectric portions 52, e.g., a material having a resistance of $10^{13}$ Ωcm or above and to which carbon, for example, is added to reduce the resistance to $10^8$ Ωcm or below.

Usually, the toner supply roller 6 plays the role of developer conveying means for conveying the toner to the surface of the developing roller 5. In the illustrative embodiment, the roller 6 additionally plays the role of charging means for depositing charges on the dielectric portions 52 of the roller 5, and electrode means facing the surface of the roller 5 at a predetermined distance. Specifically, the roller 6 charges the dielectric portions 52 of the roller 5 to a polarity opposite to that of the toner by friction. For this purpose, at least the surface of the roller 6 is formed of a material capable of so charging the dielectric portions 52. When the roller 6 is further expected to frictionally charge the toner from the hopper at the position where the rollers 5 and 6 contact, it will be made of a material intermediate between the toner and the dielectric portions 52 with respect to the frictional charge series. It is to be noted that the roller 6 may frictionally charge the conductive portions 51 to the same polarity as the dielectric portions 52 if allowable in relation to the frictional charging characteristic of the conductive portions 51. On the other hand, a great number of micropores are formed in the surface of the roller 6, so that the inner periphery of the pores may implement the electrode function. For this purpose, the micropores are formed to a depth which maintains (i.e., not disturb) the microfields to be formed by the charges deposited on the dielectric portions 52, as will be described. At the same time, at least the inner periphery of each micropore is made of a conductive material. The inner periphery of the micropores is maintained at a potential which forms between the roller 6 and the dielectric portions 51 electric fields exerting an electrostatic force on the frictionally charged toner from the above-mentioned inner periphery toward the portions 51, i.e., a potential differing from the potential of the conductive portions 51 in such a manner as to form electric fields in such a direction.

The toner supply roller 6 may be constituted by a metallic core held at a predetermined potential, and an elastic foam layer formed on the core and having conductivity and a predetermined frictional charging characteristic (referred to as a sponge roller hereinafter). Preferably, the resistance of the sponge roller should be less than the semiconduction level. As shown in FIG. 2A, to provide the micropores of the sponge roller with the electrode function, a power source 21 may apply a predetermined voltage to the sponge roller. At a position A where the roller 6 contacts the roller 5, the surface of the roller 6 moves in the same direction as that of the roller 5 and at a peripheral speed of, for example, about 0.6 to 1.5 times as high as that of the roller 5.

The agitator 7 supplies the toner from the hopper to the surface of the toner supply roller 6 while agitating it, as stated earlier. However, the agitator 7 is omissible if the toner can be fed to the roller 6 by gravity due to the configuration of the hopper and the fluidity of the toner.

The partition 10 prevents the toner in the hopper from directly reaching the neighborhood of the developing roller 5 while allowing the toner to be fed to the toner supply roller 6. However, the partition 10 is also omissible if the hopper, for example, is so configured as to prevent the toner from directly reaching the neighborhood of the roller 5.

The blade 8 contacts the developing roller 5 at a pressure as low as about 10 g/cm to about 20 g/cm in the case of noncontact development or at a pressure of about 30 g/cm in the event of contact development. Why the contact pressure is higher in contact development than in noncontact development is as follows. In the event of contact development, since the transfer ratio of the toner to the drum 1 is comparatively high, the required amount of toner deposition on the roller 5 is relatively small, e.g., about 0.8 mg/cm$^3$ to 1.0 mg/cm$^3$. The blade 8, like the surface layer of the toner supply roller 6, should preferably be made of a material intermediate between the toner and the dielectric material 52 with respect to the frictional charge series.

In operation, the agitator 7 supplies the toner from the hopper to the surface of the toner supply roller 6 which is exposed to the hopper at a supply section between the lower edge of the partition 10 and the lower wall of the casing 3. The toner is deposited in the micropores of the sponge roller 6 or on the surface of the brush roller 6 and transported to the contact position A where the rollers 5 and 6 contact by the roller 6. At the same time, part of the surface of the developing roller 5 moved away from the developing region 9 also enters the contact position due to the counterclockwise rotation of the roller 5.

At the contact position, the surface of the roller 6 and that of the roller 5 each moves at a particular speed.

Figure 4A:
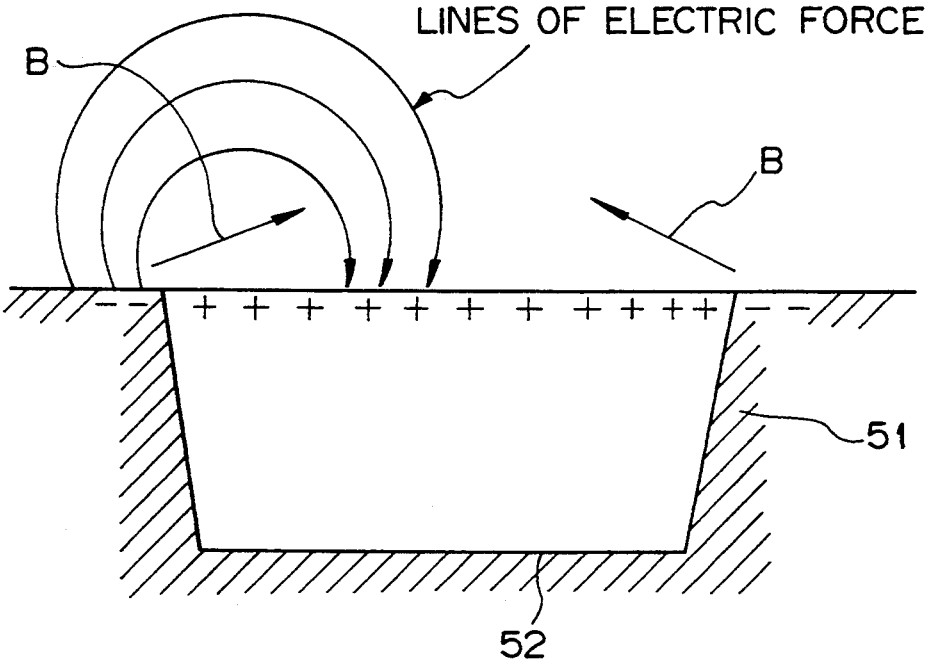
FIG. 4A shows a dielectric portion included in the developing roller together with an electric field formed in the vicinity thereof.

Hence, due to the friction among the roller 5, toner 4 and roller 6, a charge opposite in polarity to the toner is deposited on the dielectric portions 52 of the roller 5. Here, the charge on the portions 52 will be the same in polarity as the charge on the drum 1 in the case of regular or positive-to-positive (P/P) development or opposite to the latter in the case of reversal or negative-to-positive (N/P) development. Since the conductive portions 51 adjoining the dielectric portions 52 are connected to ground, a charge opposite in polarity to the charge of the dielectric portions 52 is induced in the portions 51. As a result, as shown in FIGS. 3B and 4A, microfields are formed between the two different kinds of portions 51 and 52 and mainly consist of components parallel to the surface of the roller 5 and components perpendicular to the same. On the other hand, since the roller 6 is moving in the same direction as the roller 5, the toner deposited on the roller 6 is rubbed at the contact position A, and most of it is charged to a desired polarity (opposite to the polarity of the drum 1 in the case of regular development or identical with the same in the event of reversal development).

Figure 4B:
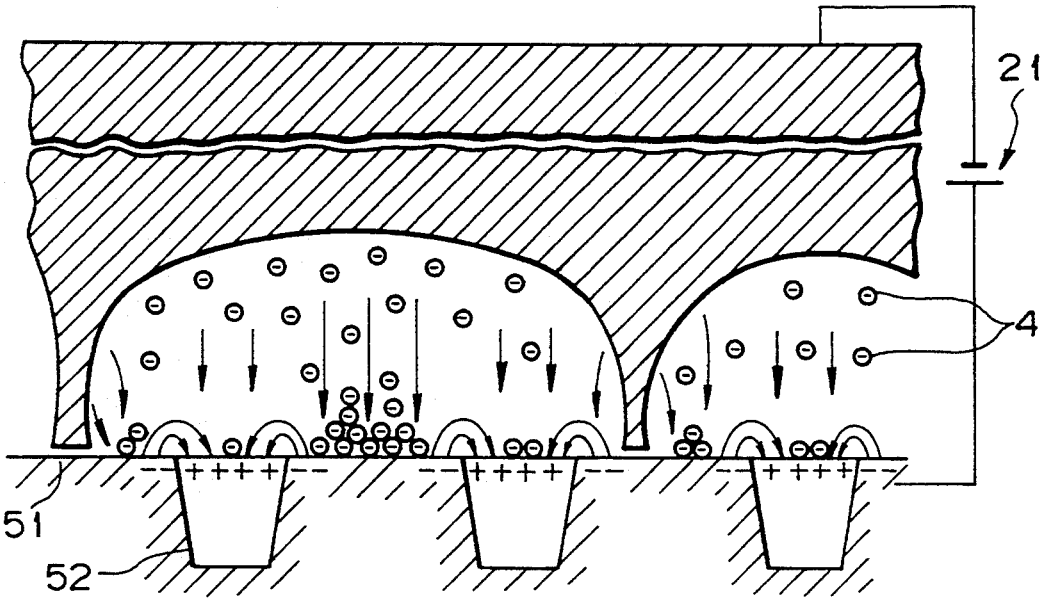
FIG. 4B shows electric fields generated at a position where the developing roller and micropores of a toner supply roller face.

At the contact position A, a predetermined potential difference exists between the rollers 5 and 6. Hence, electric fields substantially perpendicular to the surface of the roller 5 are formed (referred to as bias electric fields hereinafter). The bias electric fields are more intense at the conductive portions 51 of the roller 5 than at the dielectric portions 52. This is because while the conductive portions 51 serve as a counter electrode for the roller 6, the electrode is slightly spaced apart in the dielectric portions 52. Further, as shown in FIG. 4B, since the micropores of the roller 6 are so dimensioned as not to disturb the microfields even at the contact position A, the microfields are maintained. Consequently, at the contact position A, the microfields due to the frictional charge of the dielectric portions 52 and the bias electric fields exist together on the surface of the roller 5.

As the toner is fed to the micropores and then frictionally charged by the roller 6 or the roller 5, the microfields exert a force on the toner for moving it toward the boundaries between nearby conductive portions 51 and dielectric portions 52. At the same time, the bias electric fields exert a force on such part of the toner for moving it mainly toward the conductive portions 51. As a result, the toner caught by the microfields is retained more intensely than usual at the boundaries between the conductive portions 51 and the dielectric portions 52. The toner deposited on such boundaries weaken the microfields (see FIG. 5A). Once the toner is deposited on the conductive portions 51 in multiple layers, it is not disturbed even when the surface of the roller 6 around the micropores exert a force tending to rub the toner layer, i.e., a scavenging force. In this manner, the microfields and bias electric fields on the roller 5 allow the toner to form multiple layers stably. Even after the toner on the roller 5 has been consumed by development, the toner is again deposited on the roller 5 in the predetermined amount as the roller 5 passes the contact portion A once (see FIG. 5B).

As stated above, the multiple toner layers on the roller 5 are preserved despite an external force, e.g., the force of the blade 8. Although the toner also deposits on the dielectric portions 52, a greater amount of toner deposits on the conductive portions 51 due to the mirror force of the charged toner.

The developing roller 5 leaves the contact portion A while carrying the sufficiently charged toner in multiple layers thereon. In the embodiment, since the rollers 5 and 6 move in the same direction at the contact position A, the uncharged toner in the hopper is prevented from depositing on part of the roller 5 moved away from the contact portion A despite the rotation of the roller 6.

After the toner on the developing roller 5 has been regulated in thickness by the blade 8 lightly contacting the roller 5, it is transported to the developing region 9. In this region 9, the surface of the roller 5 applied with an optimal bias and that of the drum 1 move at substantially the same speed, thereby effecting contact development or noncontact development. At this instant, the conductive portions 51 of the roller 5 exhibit an electrode effect to form electric fields facilitating the transfer of the toner from the roller 5 to the drum 1.

As described above, in the illustrative embodiment, the developing roller 5 has fine dielectric portions 52 and fine conductive portions distributed together on the surface thereof, the conductive portions 51 being connected to ground. The toner supply roller 6 frictionally charges the dielectric portions 52 to form microfields on the roller 5. The roller 5, therefore, attracts a great amount of toner with ease and allows it to form multiple toners thereon.

The roller 6 is formed with micropores in the surface thereof while a particular potential is applied to each of the rollers 5 and 6. As a result, the microfields and the bias electric fields ascribable to the potential difference and substantially perpendicular to the surface of the roller 5 exist together at the position A where the rollers 5 and 6 contact. This insures the multiple toner layers on the roller 5.

The toner deposited on the conductive portions 51 leave the contact position A while being surrounded by the toner strongly retained by the microfields including intense components parallel to the surface of the roller 5 as well. It follows that the toner on the conductive portions 51 will not be easily disturbed by an external force which may act thereon later. This allows a sufficient amount of toner to reach the developing region 9.

Since the rollers 5 and 6 move in the same direction at the contact portion A, the uncharged toner in the hopper is prevented from depositing on part of the roller 5 moved away from the position A despite the rotation of the roller 6. This protects the amount of toner deposition on the roller 5 from changes in environment and sets up a charge distribution with a minimum of uncharged toner, thereby stabilizing the developing characteristic. Therefore, not only equispeed development can be practiced, but also a blade, for example, for removing uncharged toner from the upper toner layer on the roller 5 is omissible to simplify the construction.

The roller 5 and drum 1 move substantially at the same speed in the developing region 9. This eliminates the previously discussed local increase in image density and, therefore, frees a color image from an excessive density at the rear edge thereof.

Since the toner layers on the roller 5 do not include uncharged toner, an attractive image is achievable which has a clear background and high resolution.

It is to be noted that as the resistance of the toner decreases, the toner charges more rapidly and forms layers which can be fed to the developing region 9 more efficiently. Therefore, the resistance of the toner should preferably be $10^{13}$ Ωcm or below. However, when it comes to an image forming apparatus of the type transferring a toner image from a photoconductive element to a sheet by applying a transfer electric field, excessively low resistances would make the image transfer defective; an adequate range will be $10^6$ Ωcm to $10^{12}$ Ωcm.

Specific examples of the illustrative embodiment will be described hereinafter.

EXAMPLE 1

(1) Developing roller 5: A metallic core in the form of a roller was knurled to form 0.1 mm deep and 0.2 mm wide grooves in checkers at a pitch of 0.3 mm and an angle of 45 degrees. The knurled surface of the core was coated with an epoxy-modified silicone resin (SR2115 available from Toray) and then dried at 100° C. for about 30 minutes to form a dielectric layer. The surface of the roller was machined to cause the core to appear as the conductive portions 51. The resin filled in the grooves constituted the dielectric portions 52. The conductive portions 51 occupied 50% of the entire surface of the resulting roller, i.e., the dielectric portions 52 occupied the other 50%. The surface roughness R was selected to be 3 μm to 20 μm, preferably 5 μm to 10 μm.

(2) Toner supply roller 6: Use was made of a sponge roller having a diameter of 14 mm and the conductive foam elastic layer 15. This layer 15 was formed of carbon-containing foam polyurethane whose volume resistivity was about $1\times10^6$ Ωcm. The toner supply roller 6 was caused to bite into the developing roller 5 by 1 mm. The micropores in the surface of the sponge roller were measured to have a mean diameter of 0.2 mm to 0.3 mm.

(3) Bias for toner supply roller 6: A bias of the same polarity as the DC component of the developing roller 5 which will be described and greater in absolute value than the latter by 100 V, specifically a DC bias of −600 V, was applied to the metallic core 14 of the sponge roller.

(4) Blade 8

A 2 mm thick elastic plate made of urethane rubber was urged against the developing roller 5 at a pressure of 10 g/cm to 20 g/cm.

(5) Bias and gap for development: An AC bias having a peak-to-peak voltage of 1000 V and a frequency of 1000 Hz and on which DC −500 V was superposed (or a DC bias of −800 V) was applied to the developing roller 5. The gap for development was selected to be 150 μm.

(6) Photoconductive element: Organic photoconductor (OPC) was used and uniformly charged such that the negative latent image was −850 V in the background or −150 V in the image portion.

(7) Toner: A negatively chargeable toner was used which was a combination of nonmagnetic styreneacryl-based resin and polyester-based resin. 0.5 w t% of fine powder was applied to the toner.

(8) Evaluation: The toner was found deposited on the developing roller 5 in an amount of 1.5 mg/cm$^2$ to 2.0 mg/cm$^2$, with a mean charge of 8 μc/g to 15 μc/g, and in a charge distribution with a minimum of uncharged toner. The resulting image was free from background contamination and, regarding solid images and lines, uniform in density distribution and clear-out. It is to be noted that the diameter of the micropores was found to be substantially twice as great as the pitch of the dielectric portions 52.

EXAMPLE 2

Development was effected under the same conditions as in Example 1 except that the photoconductive element was implemented as a belt shown in FIG. 6, that the gap for development was zero to effect contact development, that the contact pressure of the blade 8 was 30 g/cm, and the bias was −600 V. The toner was deposited on the developing roller 5 in an amount of 0.8 mg/cm$^2$ to 1.0 mg/cm$^2$ and found to be as desirable as the toner in Example 1.

EXAMPLE 3

Development was effected under the same conditions as in Example 1 except that a hard photoconductive drum shown in FIG. 7 was used, that the developing roller 5 was implemented as a soft roller having dielectric particles whose resistance was $10^{13}$ Ωcm or above dispersed on an elastic conductive base and having a hardness of 30 to 70 degrees in the JIS scale as measured from the surface, that the gap for development was zero to effect contact development, that the contact pressure of the blade 8 was 30 g/cm, and that −600 V was applied as the bias for development. The toner was found deposited on the developing roller 5 in an amount of 0.8 mg/cm$^2$ to 1.0 mg/cm$^2$, and the resulting image was attractive.

EXAMPLE 4

Development was effected under the same conditions as in Example 1 except that the hard photoconductive drum, FIG. 7, was used, that the developing roller 5 had a hardness of 70 degrees to 100 degrees, preferably 90 degrees to 100 degrees and was implemented by a material which will be described, that the gap was zero mm for contact development, and that −600 V was applied as the bias for development. The toner was found deposited in an amount of 1.0 mg/cm$^2$ to 1.2 mg/cm$^2$ and reproduced a desirable image. In this Example, contact development was effected by a small nip width between the hard photoconductive element and the developing roller. For this reason, even when the photoconductive element and developing roller were slightly different in linear velocity, an attractive image free from background contamination and local increase in image density was achieved due to the narrow nip width. The local increase in image density was inconspicuous even when the linear velocity ratio was increased at the time of development. The relatively hard developing roller 5 is advantageous in respect of accuracy. The developing roller 5 had a 5 mm thick surface layer constituted by a conductive resin having dielectric particles dispersed therein. Specifically, the conductive resin was comprised of an acryl resin, urethane resin or elastomer in which carbon black was dispersed. The dielectric particles was implemented by polyamide resin or similar resin which is intensively chargeable to negative polarity. The developing roller 5 had a resistance of $1\times10^8$ Ωcm or below.

EXAMPLE 5

Development was effected under the same conditions as in Example 1 except that the photoconductive belt shown in FIG. 6 was used, and that the contact pressure of the blade 8 was 30 g/cm. The toner deposition was measured to be 0.8 mg/cm$^2$ to 1.0 mg/cm$^2$, and the resulting image was attractive.

EXAMPLE 6

Development was effected under the same conditions as in Example 1 except that the developing roller 5 had a diameter of 20 mm and had a surface layer constituted by a conductive resin (acryl resin, urethane resin or similar resin in which carbon black was dispersed) in which dielectric particles (acryl resin, polyamide resin or similar resin) having a particle size of 50 μm to 150 μm was dispersed. The toner was found deposited in an amount of 1.5 mg/cm$^2$ to 2.0 mg/cm$^2$ and with a charge of 8 μc/g to 15 μc/g, and the resulting image was attractive. In this Example, the toner had a resistance of $7\times10^{10}$ Ωcm.

EXAMPLE 7

Development was effected under the same conditions as in Example 1 except that the photoconductive belt shown in FIG. 6 was used, contact development was effected with a gap of zero mm, that the contact pressure of the blade 8 was 30 g/cm, and that −600 V was applied as the bias for development. The toner was found deposited in an amount of 0.8 mg/cm$^2$ to 1.0 mg/cm$^2$, and the resulting image was attractive.

Hereinafter will be described the electric characteristic of the toner supply roller 6, the bias to be applied to the roller 6 and so forth specifically.

The toner supply roller 6 forms predetermined electric fields in the position A where it contacts the developing roller 5 due to a potential difference, as stated earlier. Hence, the leak between the rollers 5 and 6 should be reduced as far as possible. For this purpose, the roller 6 may advantageously be made semiconductive. The rollers used in Examples 1–7 satisfy this condition since their foam conductive layers have a volume resistivity of about $1\times10^6$ Ωcm.

Various conditions determined to be suitable for the roller 6 to become semiconductive by extended studies are as follows.

To begin with, the voltage to be applied from the power source 21 to the metallic core 14 of the roller 6 carrying the semiconductive layer will be described. Experiments showed that when the potential difference between the roller 5 and the core 14 was confined in the range of from 50 V to 300 V, the charged toner was desirably transferred from the roller 6 to the roller 5 to form optimal layers on the roller 5. Specifically, when the potential difference was less than 50 V, there was not achieved the effect of increasing the amount of toner deposition; when it was greater than 300 V, a leak occurred between the roller 5 and the roller or sponge roller 6 to prevent a stable potential difference to be set up although the deposition saturated in an amount of 1.5 mg/cm to 2.0 mg/cm.

To set up the above potential difference, the intrinsic volume resistivity between the rollers 5 and 6 should preferably be $10^6$ Ωcm to $10^{10}$ Ωcm. Then, by setting a current I at or lower than 500 μS, it is possible to reduce wasteful power consumption of a power pack and to achieve the desired electric fields, i.e., the desired toner supply without lowering the voltage to be applied.

Assume that the roller 6 is implemented as a roller having an elastic layer of foam polyurethane in which a conductive material is dispersed, that the roller or sponge roller 6 contacts the roller 5 over a width of 30 cm and a nip width of 0.587 cm and to such a degree that the sponge layer is 0.4 cm thick, and that a bias of 150 V is applied. Then, if the observed current is 2 μA, i.e., if the resistance is $7.5\times10^7$ Ω, the intrinsic volume resistivity will be $3\times10^9$ Ωcm which satisfies the above-mentioned condition.

Figure 14A:
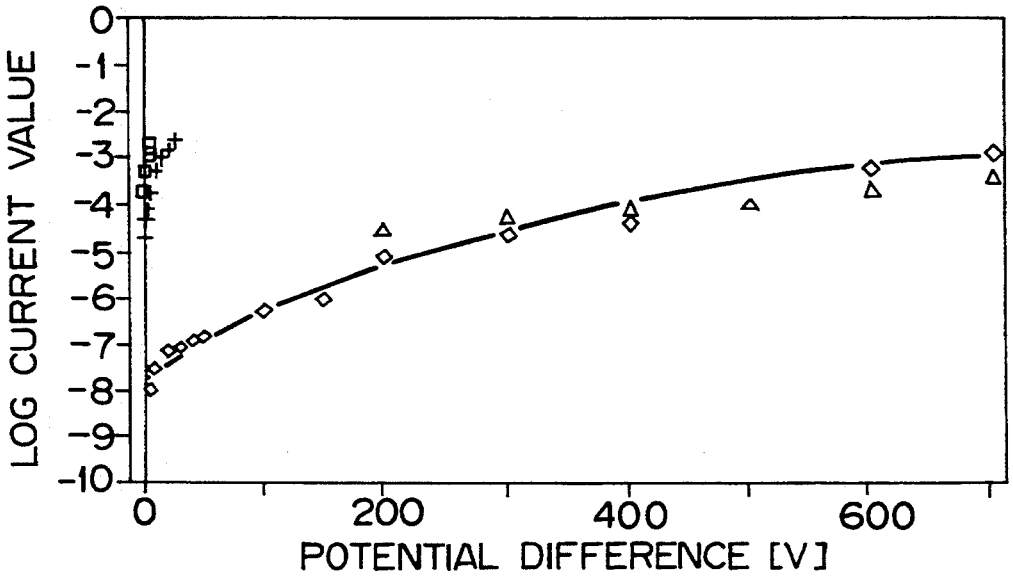
FIG. 14A shows a curve indicative of a relation between the potential difference between the developing roller and the toner supply roller and the current to flow through the rollers.
Figure 14B:
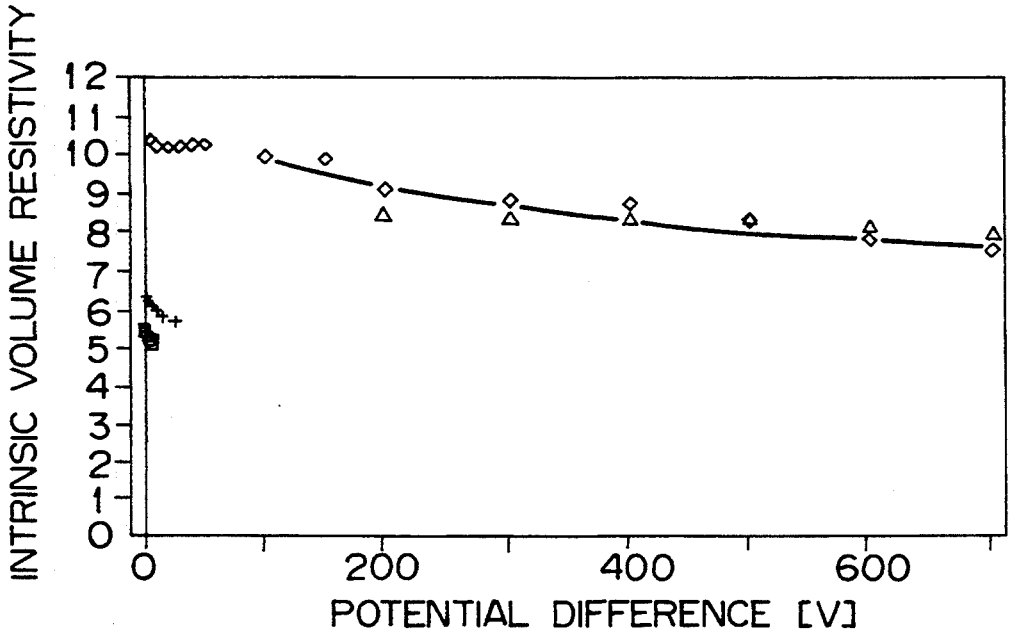
FIG. 14B plots a relation between the potential difference and the intrinsic volume resistivity of the toner supply roller.

FIGS. 14A and 14B show respectively a relation between the potential difference and the logarithmic value of the current and a relation between the potential difference and the logarithmic value of the intrinsic volume resistivity. These relations are indicated with respect to the above-described examples satisfying the above condition when the intrinsic volume resistivity is $3\times10^9$ Ωcm, and a single conventional example whose intrinsic volume resistivity is lower than the lower limit of the above condition. Among the symbols representative of sampling points, rhombs and triangles pertain to the examples of the embodiment and indicate respectively a case wherein the toner does not exist in the hopper and a case wherein it exists in the hopper. Likewise, squares and crosses pertain to the conventional example and are identical with the rhombs and triangles as to the condition of the hopper.

In FIGS. 14A and 14B, the sampling points associated with the bias of 150 V and pertaining to the conventional example are not shown. In fact, in the conventional example, the observed current was far greater than $\log_{10}I>-3$, i.e., 1 mA and exceeded the supply capacity of the power pack of the machine body. As a result, a leak occurred to lower the voltage. In such a condition, the resistance is lower than $10^6$ Ωcm and not adequate. By contrast, in the examples of the embodiment, an electric field for applying an adequate voltage is achieved to feed an adequate amount of toner. As the curves indicate, whether or not the toner exists in the hopper does not critically effect the results.

It was also found that if the roller 6 bites into the roller 5 by 0.3 mm to 1.8 mm and if the speed ratio is 0.5 to 2.5 times higher, the roller 6 exerts an adequate scavenging force on the roller 5 to set up an optimal amount of charge and an optimal amount of toner deposition. When the amount of bite is less than 0.3 mm, the friction is short to reduce the amount of charge of the toner; when it is greater than 1.8 mm, the rotation torque increases to increase the load on the motor. Further, if the velocity ratio is less than 0.5 times higher, the amount of toner supply cannot follow the consumption to prevent the initial deposition from being restored by a single supply; if it is greater than 2.5 times, the rotation torque also increases to increase the load on the motor.

It was further found that desirable toner layers can be formed even if a bias alternating with the potential of the roller 5 is applied to the roller 6. Presumably, this is because the charged toner moves in both directions at the contact position A of the rollers 5 and 6, i.e., the charged toner caught in the surface of the roller 6 is also desirably transferred to the surface of the roller 5 to increase the supply efficiency. For example, when the bias for development is DC −800 V, an AC bias on which DC −800 V is superposed and having a peak-to-peak voltage of 500 V and a frequency of 300 Hz is applied to the sponge roller 6. When an AC bias having a peak-to-peak voltage of 600 V and a frequency of 1 kHz and on which DC −500 V is superposed is applied as the bias for development, DC −500 V is applied to the sponge roller 6. Further, an AC bias having a peak-to-peak voltage of 1200 V and a frequency of 750 kHz and on which DC −600 V is superposed is used as the bias for development, a bias shown in FIG. 13B is applied to the sponge roller 6.

In the above specific cases, the roller 5 and sponge roller 6 may be connected together by a Zener diode or a capacitor and applied with biases which are of the same phase and same waveform, but shifted by the DC component. Then, a single bias generator suffices in applying to the sponge roller 6 a periodic bias of the same phase as the potential of the roller 5 and on which DC of the same polarity as the toner is superposed.

To form the semiconductive foam elastic layer (conductive sponge), it is preferable to disperse the conductive material before foaming, as determined by experiments. Specifically, while it has been customary to provide an insulative foam polyurethane with conductivity by depositing a conductive impregnating material, carbon black or similar conductive material is mixed with and dispersed in a raw material and then caused to foam together.

In the conductive sponge produced by the conventional method, a current mainly flows through the conductive impregnating material of the surface layer of foam polyurethane. By contrast, since the above-stated preferred method allows the material to have a uniform resistance over the entire volume and, therefore, causes a current to uniformly flow in the bulk direction. Assume that the surface is deteriorated due to aging, i.e., the conductive impregnating material comes off. Then, the conventional conductive sponge increases the resistance to degrade the toner supplying ability while the conductive sponge produced by the preferred method does not change the resistance and, therefore, preserves the desirable toner supplying ability.

Figure 13A:
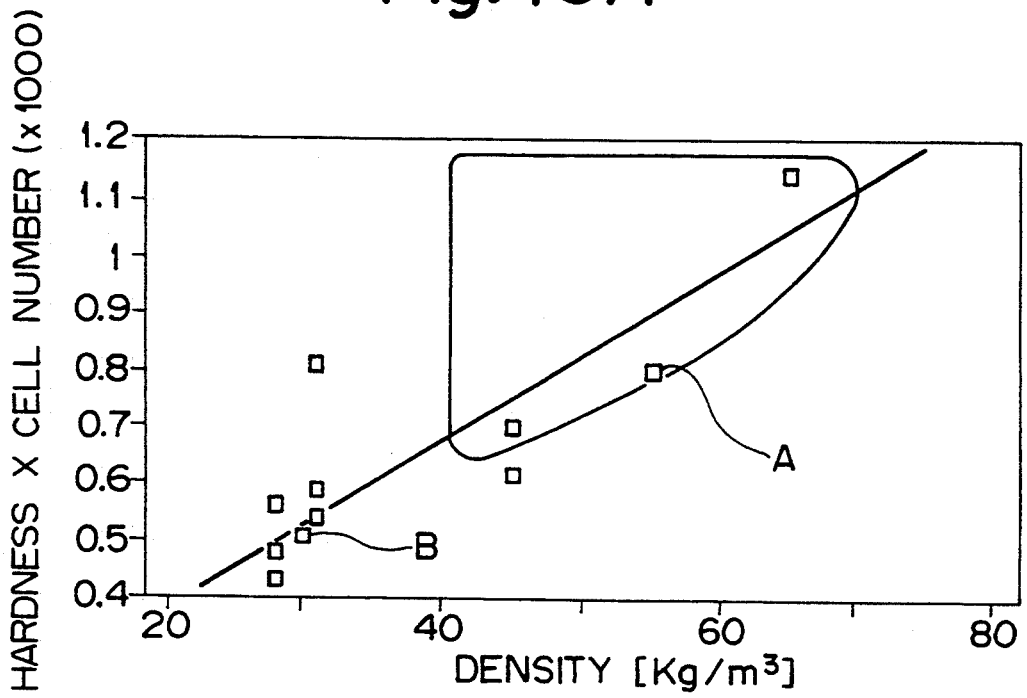
FIG. 13A plots a characteristic derived from a toner supply roller implemented as a sponge roller.
Figure 13B:
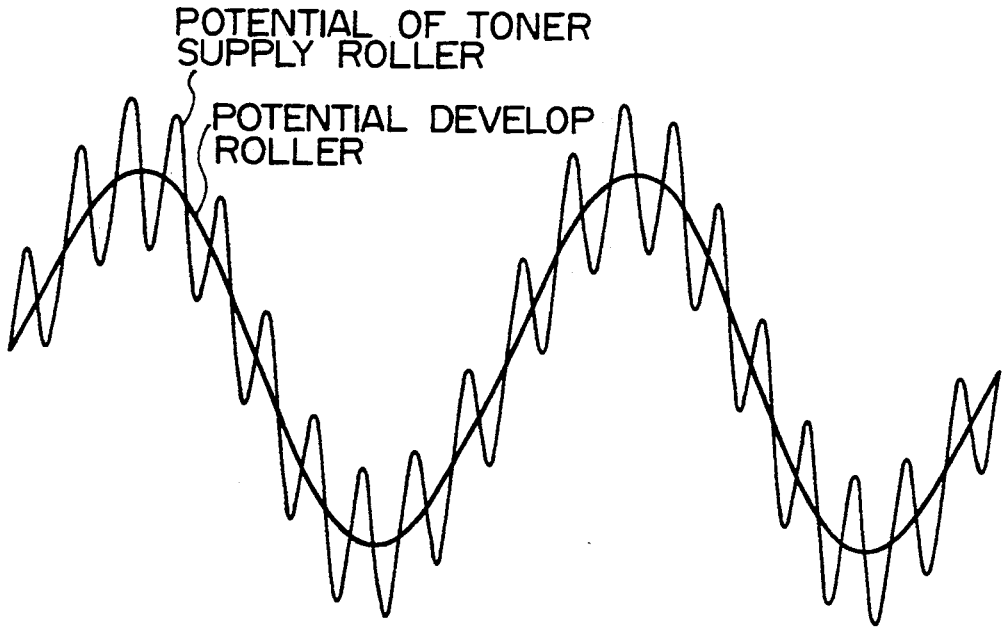
FIG. 13B shows a waveform representative of a specific bias to be applied to the toner supply roller.

As shown in FIG. 13A, the foam elastic material forming the roller 6 has the shape characteristic thereof determined by a relation between the apparent density (X) and the product (Y) of a hardness and the number of cells. It is preferable to use a foam elastic material whose relation between X and Y is greater than one in which Y satisfies a line ($40X-3Y+500=0$) when X is greater than or equal to 40, as determined by experiments. Generally, the apparent density and the product of hardness and cell number is considered to contribute a great deal to the charging efficiency when a toner is charged by friction. Specifically, as the developer is nipped by the developing roller 5 and the supply member and compressed therebetween, the probability of contact and, therefore, the charging efficiency is increased. However, this factor also joins in the transport of the developer from the hopper. It follows that micropores of the supply member are directly representative of the toner transporting ability. This is contradictory to the previously stated charging effect. In the light of this, an adequate relation between the apparent density and the product of hardness and cell number was determined by experiments, as shown in FIG. 13A.

Specifically, in FIG. 13A, a type A satisfies the above condition since the hardness and the number of cells are respectively 20 and 40 for an apparent density of 55, i.e., $Y=800$ for $X=55$. With the type A, it was possible to supply the toner in an amount of 1.5 mg/cm$^2$. By contrast, a type B does not satisfy the condition since the hardness and the number of cells are respectively 12 and 42 for an apparent density of 30, i.e., $Y=504$ for $X=30$. The amount of toner supply particular to the type B was measured to be as small as 1.0 mg/cm$^2$.

Figure 12:
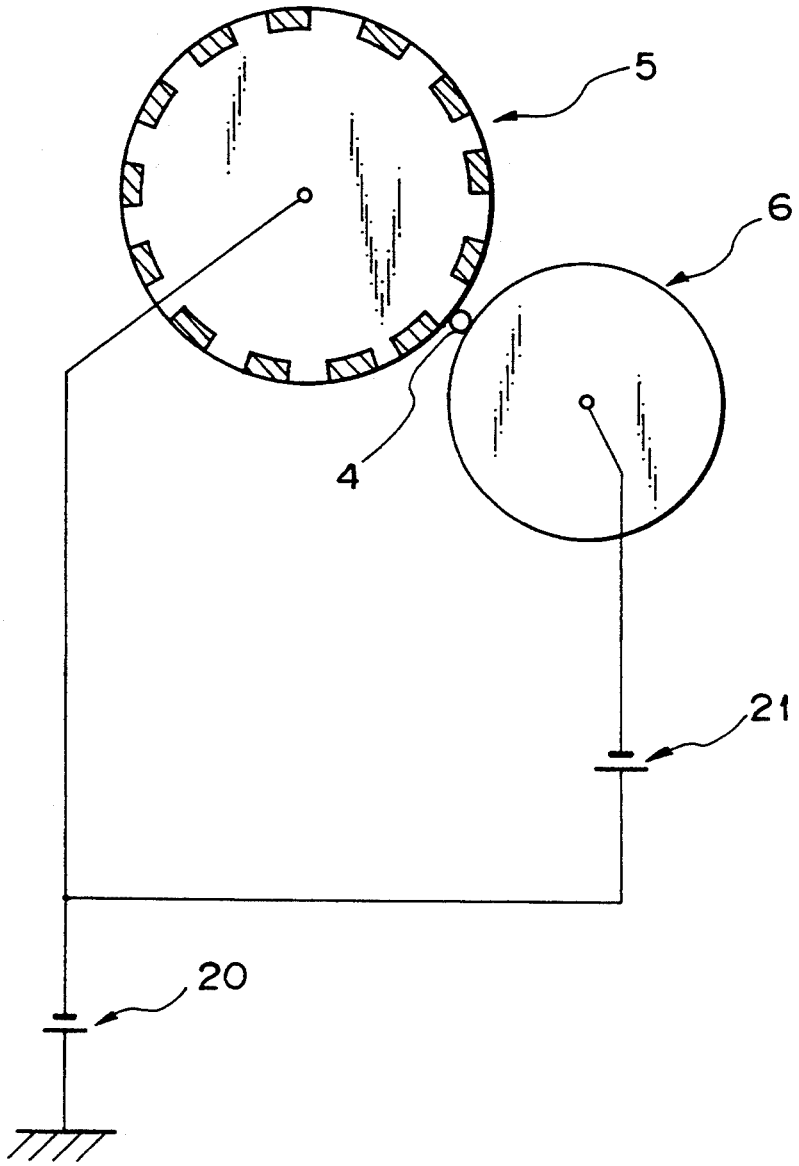
FIG. 12 schematically shows a potential difference between the developing roller and the toner supply roller.

While the above description has concentrated on the roller 6, the roller 5 may be made semiconductive in place of the roller 6. The gist is that one of the rollers 5 and 6 is made semiconductive while the other is made conductive. In this case, as shown in FIG. 12, the potential difference between the rollers 5 and 6 is maintained by the resistance of the toner 4 at the contact position A where the rollers 4 and 6 contact. Hence, use has to be made of a toner having an intrinsic volume resistivity which does not cause dielectric breakdown to occur despite the difference between the voltages applied to the rollers 5 and 6. for example, the toner can be efficiently supplied in an arrangement wherein the potential difference is 200 V or below, one of the conductive portions 51 of the roller 5 and the roller 6 has an electric resistance of $1\times10^6$ Ωcm to $1\times10^9$ Ωcm, the other has an electric resistance of $1\times10^6$ Ωcm or below, and the electric resistance of the toner is $1\times10^{13}$ Ωcm or above.

In the specific examples described above, a charge opposite in polarity to the toner is applied to the dielectric portions 52 of the roller 5 to form the microfields. Alternatively, a charge of the same polarity as the toner may be applied to the dielectric portions 52, as will be described with reference to FIGS. 10A, 10B, 11A and 11B. This is also successful in forming the microfields or in increasing the amount of toner deposition by the coexisting microfields and bias electric fields.

Figure 5A:
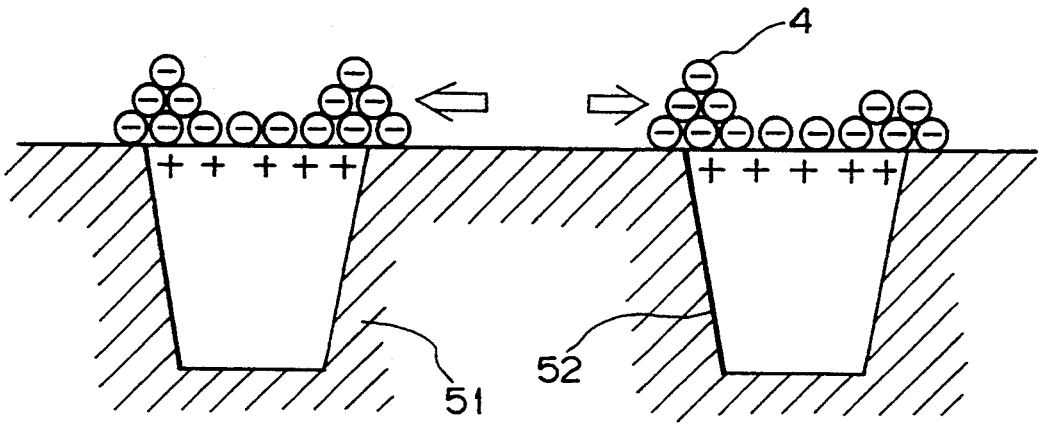
FIG. 5A shows how a toner is deposited by the dielectric portions and electric fields adjoining them.
Figure 5B:
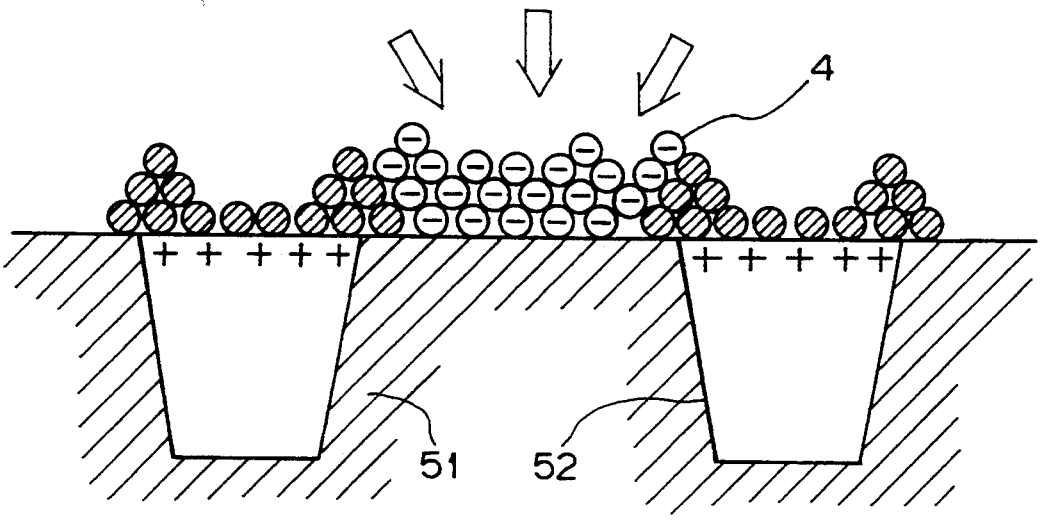
FIG. 5B show how the toner is deposited by the electric fields at the position shown in FIG. 4B.
Figure 10A:
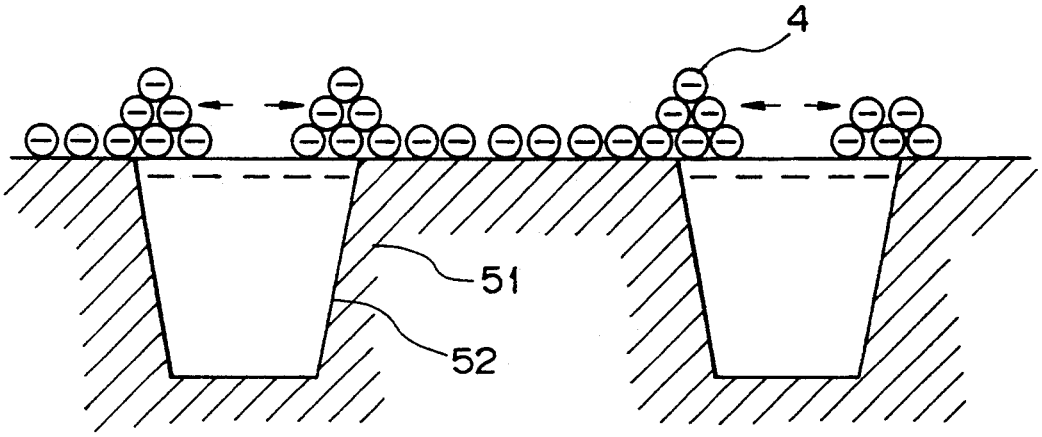
FIG. 10A shows dielectric portions of a developing roller representative of an alternative embodiment of the present invention and electric fields formed in the vicinity thereof.
Figure 10B:
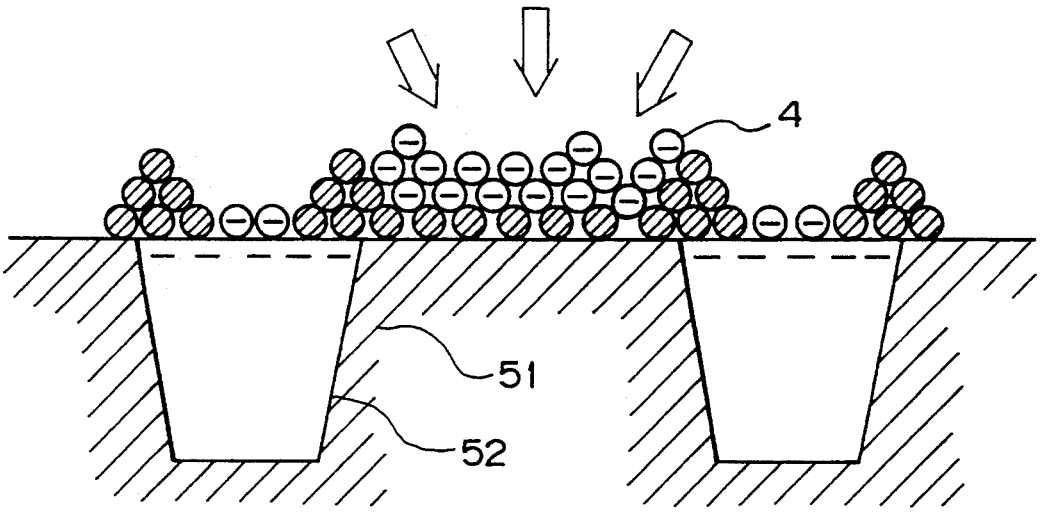
FIG. 10B show electric fields generated between the developing roller and micropores of a toner supply roller in the alternative embodiment.
Figure 11A:
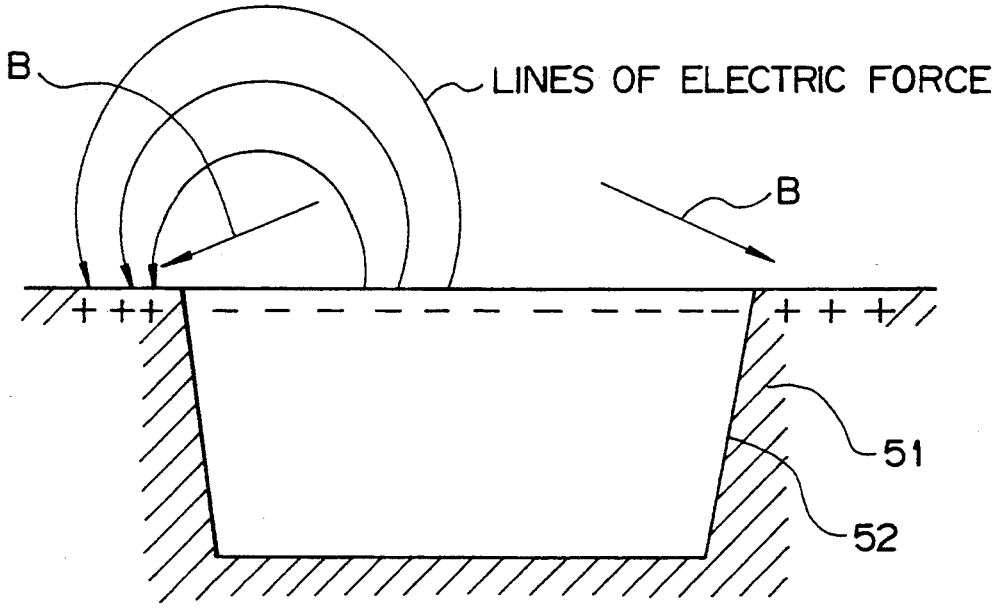
FIG. 11A indicates how a toner is deposited by a dielectric portion and an electric field.
Figure 11B:
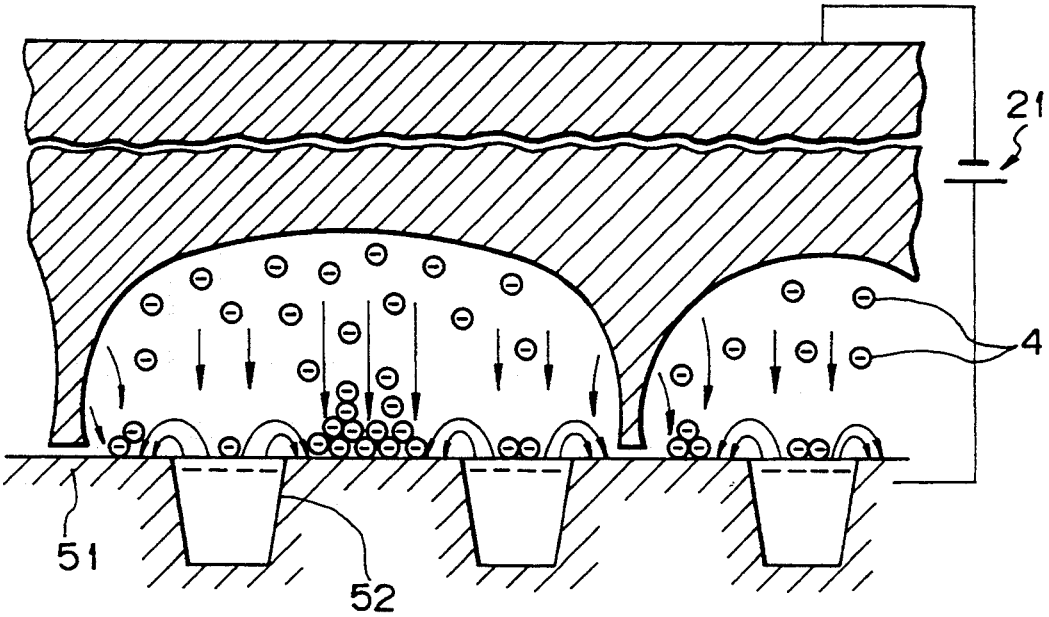
FIG. 11B shows how the toner is deposited by electric fields at the facing position.

FIGS. 10A and 10B correspond to FIGS. 4A and 4B while FIGS. 11A and 11B correspond to FIGS. 5A and 5B. For example, as shown in FIG. 10A, as the rollers 5 and 6 rub against each other, a frictional charge of the same polarity as the toner 4 is deposited on the dielectric portions 52. The resulting microfields cause the toner to deposit on the boundaries between the dielectric portions 52 and the conductive portions 51. In this case, assuming that the toner 4 is negatively charged, the positively charged roller 6 and blade 8 are greater than the roller 5 and toner 4 with respect to the frictional charge series. The dielectric portions 52 of the roller 5 may be formed of a teflon resin or a polyethyrene resin; the roller 6 and blade 8 may be formed of polyurethane or polycarbonate; and the toner 4 may be formed of polystyrene or polyester.

The specific examples described above are applicable not only to reversal development but also regular development. Regarding regular development, the materials constituting the negatively charged roller (conductive and dielectric portions) will be smaller than the materials constituting the roller 6 and blade 8 which will in turn be smaller than the positively charged toner 4 with respect to the frictional charge series. The dielectric portions 52 may be made of a teflon resin or a polyethylene resin, the roller 6 and blade 8 may be made of a polyurethane resin or a polycarbonate resin, and the toner 4 may be made of a polystyrene resin or an acryl resin. The bias 20 for development may be −200 V by way of example. A specific example pertaining to the regular development is as follows.

EXAMPLE 8

(1) Developing roller 5: The roller 5 is produced by the same procedure as in the previous examples except that the dielectric layer was coated with a fluoric resin (Lumiflon 200C. available from Asahi Glass) and then dried at 100° C. for 30 minutes.

(4) Blade 8: The contact pressure of the blade 8 was 20 g/cm to 30 g/cm.

(5) Bias and gap for development: Contact development was effected with DC −200 V applied to the roller 5.

(3) Bias for toner supply roller 6: A bias of the same potential as the bias to the roller 5 was applied to the roller 6.

(6) Photoconductive element: OPC was used. The surface potential was −700 V in an image portion or −100 V in an exposed portion.

(7) Toner 4: Use was made of a positively chargeable toner constituted by a nonmagnetic styreneacryl-based resin. 0.5 wt % of fine $SiO_2$ powder (positively chargeable) was applied to the resin.

The other conditions are the same as the conditions described in relation to Example 1.

An alternative embodiment of the present invention will be described which is capable of forming toner layers carrying a desired charge and containing a minimum of inversely charged toner and uncharged toner.

In the embodiment described with reference to FIGS. 2A, 2B, 6 and 7, the toner supply roller 6 plays the role of means for charging the dielectric portions 52 of the developing roller 5 and the role of electrode means applied with a predetermined potential and facing the roller 5 at a predetermined spacing in addition to the conventional role of means for conveying the toner to the roller 5. In the alternative embodiment to be described, among the three roles, the role of charging means is assigned to a member other than the roller 6.

Figure 15:
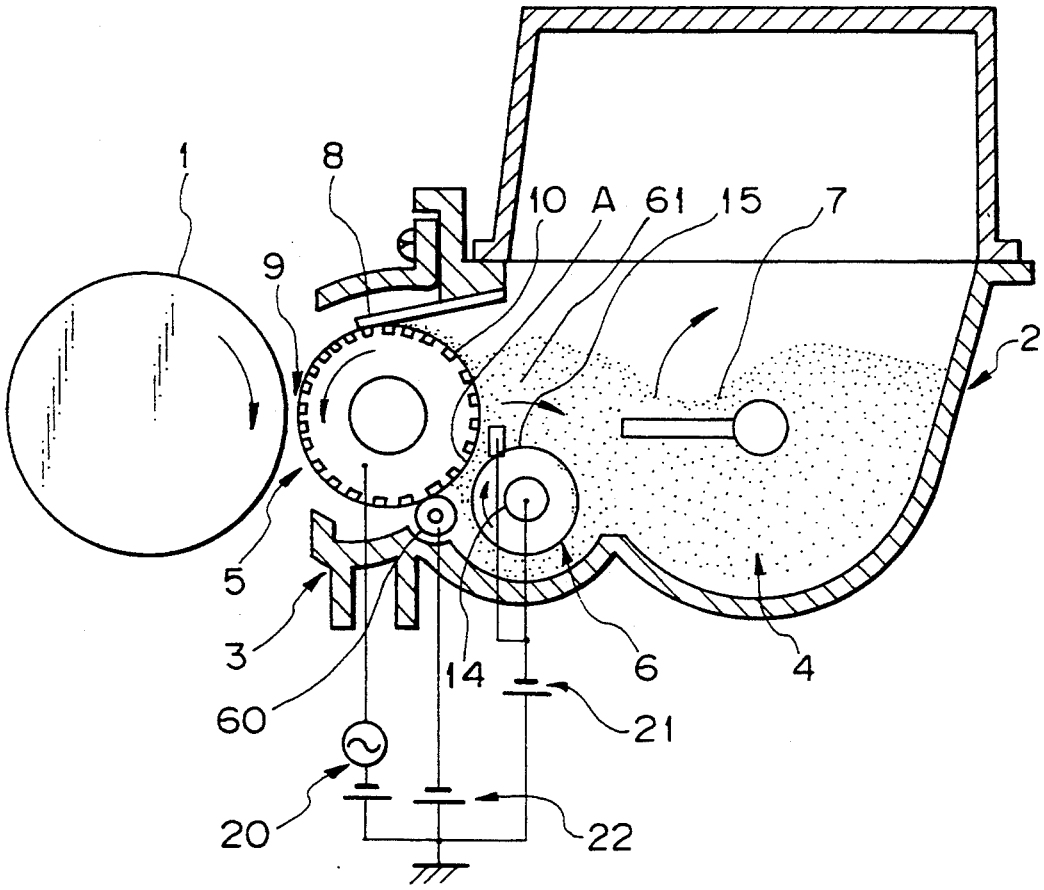
FIGS. 15, 16 and 17 are sections each showing still another alternative embodiment of the present invention.

Specifically, referring to FIG. 15, the alternative embodiment includes a charge roller, or charging means, 60 located to contact part of the surface of the developing roller 5 returned from the developing region 9 to the casing 3, and a power source 22 which applies a predetermined voltage to the roller 60. The charge roller 60 is driven by drive means, not shown, such that the surface thereof moves in the opposite direction to the surface of the developing roller 5 at a position where the rollers 60 and 5 contact. To charge the dielectric portions 52 of the roller to the opposite polarity to the toner by friction, the charge roller 60 has at least the surface thereof constituted by a material capable of so charging the dielectric portions 52. Further, at least the surface layer of the roller 60 is provided with a sponge-like configuration so as to remove the toner remaining on the roller 5. If desired, a voltage capable of generating an electrostatic force for attracting the remaining toner may be applied to between the rollers 5 and 6 in order to enhance the removal of the remaining toner from the roller 5.

In this embodiment, the toner supply roller 6 is spaced apart from the developing roller 5 by a predetermined distance for the purpose of, for example, allowing the roller 6 to serve as the electrode means with a minimum of restrictions as to the surface configuration. At least the surface of the roller 6 is also provided with a sponge-like configuration to desirably transport the toner. A scraper blade 61 is held in contact with adjoining part of the surface of the roller 6 so as to reduce the limitations regarding the surface material by allocating or separating the charging function and to surely transfer the toner from the roller 6 to the roller 5. At least the surface of the scraper blade 61 is made of a material capable of charging the toner to a predetermined polarity by friction. This material is preferably a conductive material and may be applied with a voltage, as needed.

The rest of the construction is the same as the previous embodiment. Hence, the same or similar constituents as or to those of the previous embodiment are designated by the same reference numerals, and a detailed description will not be made to avoid redundancy.

Figure 1:
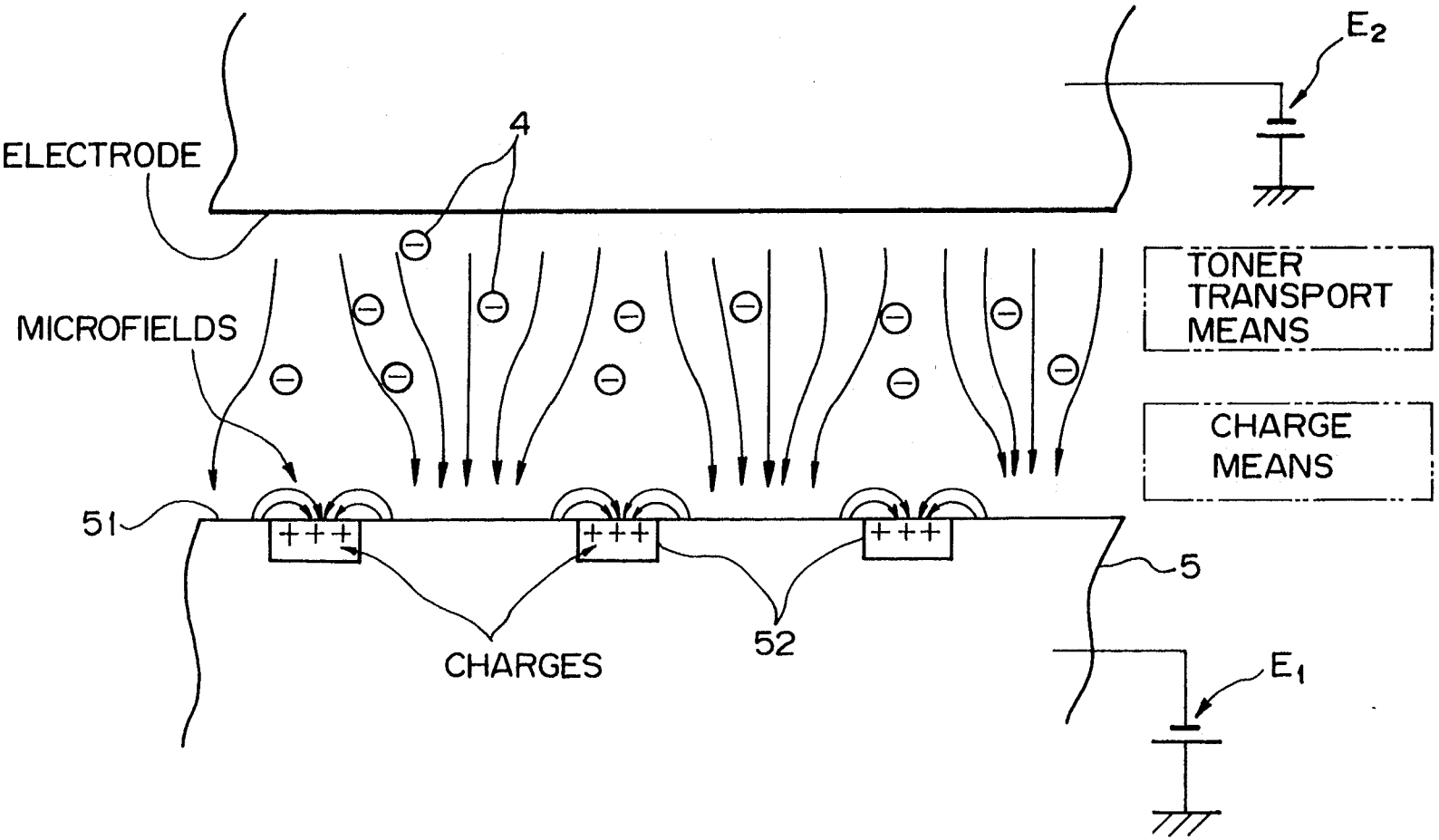
FIG. 1 schematically shows electric fields formed on a developer carrier included in a developing device embodying the present invention.

In operation, on completing development, the developing roller 5 is rotated in a direction indicated by an arrow in the figure (at a speed of about 120 mm/sec which is substantially the same as that of the drum 1) until it contacts the charge roller 60. The charge roller 60 not only removes the toner remaining on the roller 5 but also charges the dielectric portions 52 to a polarity opposite to that of the toner. Since the conductive portions 51 adjoin the dielectric portions 52 and are connected to ground, a charge opposite in polarity to the portions 52 is induced in the portions 51. As a result, microfields containing intense vertical and horizontal components are formed at the boundaries between the two portions 51 and 52 (see FIGS. 4A and 4B). As such part of the surface of the roller 5 is brought to a position where it faces the roller 6, electric fields perpendicular to the conductive portions 51 are formed between the rollers 5 and 6 since a potential of the same polarity as the toner is applied to the roller 6. Consequently, the microfields ascribable to the dielectric portions 52 and the electric fields between the rollers 5 and 6 exist at the same time (see FIG. 1).

The roller 6 in rotation conveys the toner to the position where it faces the roller 5. At the same time, the toner removed from the roller 6 by the scraper blade 61 is fed to such a position. The toner is retained in the cells or micropores and on the surface of the roller 6 and charged by the sponge. On contacting the scraper blade 61 biting into the roller 6, the charge of the toner is further increased. The toner caught by the microfields at the edges of the dielectric portions 52 is intensely held on the roller 5. Also, the charged toner deposits on the conductive portions 51 of the roller 5. In this manner, the microfields on the roller 5 and the electric fields ascribable to the potential difference between the rollers 5 and 6 are combined to cause the toner to form multiple layers stably on the roller 5. Hence, although part of the toner on the roller 1 is consumed by development, the initial toner deposition is recovered by a single toner supply step.

Although the toner also deposits on the dielectric portions 52, the amount of deposition simply matches the frictional charge deposited on the portions 52. Hence, a greater amount of toner deposits on the conductive portions 51 due to the mirror charge of the charged toner.

As the roller 5 is further rotated, the blade 8 levels the toner on the roller 5 to form uniform toner layers. Since the toner caught by the microfields at the edges of the dielectric surfaces are intensely held on the roller 5, the multiple toner layers are not disturbed despite a scavenging force which will be exerted by the blade 8. In the position where the rollers 5 and 6 contact, the roller 6 is moved in the same direction as the roller 5 and at a speed about 0.6 to 1.5 times as high as the speed of the roller 5. As a result, the toner is electrostatically deposited on the roller 5 in an amount of 1.5 $mg/cm^2$ to 2.0 $mg/cm^2$ and with a charge of 8 $\mu c/g$ to 15 $\mu c/g$. The multiple toner layers are sufficiently thin for development. The toner regulated by the blade 8 reaches the developing region 9. In the developing region, noncontact N/P development was effected with the photoconductive element and roller 5 moved at the same speed and with a bias promoting the flight of the toner applied. The resulting images were free from background contamination and rendered solid portions and lines clear-cut.

A specific example of this embodiment will be described hereinafter.

EXAMPLE 9

(1) Charge roller 60: The charge roller 60 was implemented as a sponge roller of carbon-containing foam urethane and having a diameter of 10 mm. The sponge had a volume resistivity of about $1\times10^8$ Ωcm and an apparent density of 55 kg/m$^3$ to 70 kg/m$^3$. The roller 60 bit into the roller 5 by 0.5 mm. An AC bias voltage having a peak-to-peak voltage of 1000 V and a frequency of 1000 Hz and on which DC −200 V to −300 V was superposed (or a DC bias of −500 V to −600 V) was applied to the roller 60.

(2) Toner supply roller 6: The roller 6 was implemented as a sponge roller of carbon-containing foam urethane and having a diameter of 14 mm. The gap between the rollers 6 and 5 was 1 mm. The sponge had a volume resistivity of about $1\times10^6$ Ωcm, an apparent density of 45 kg/m$^3$ to 60 kg/m$^3$, and cells whose mean diameter was 0.2 mm to 0.3 mm. An AC bias having a peak-to-peak voltage of 1000 V and a frequency of 1000 Hz and on which DC −1500 V was superposed (or a DC bias of −1800 V) was applied to the metallic core 14 of the sponge roller.

(3) Scraper blade 61: The blade 61 was made of SUS and bit into the roller 6 by 1 mm. A bias of the same potential as the bias for the roller 6 was applied to the blade 61.

The rest of the conditions was the same as in Example 1.

Hereinafter will be described another alternative embodiment also capable of forming toner layers carrying a desired charge and containing a minimum of inversely charged toner and uncharged toner.

Figure 16:
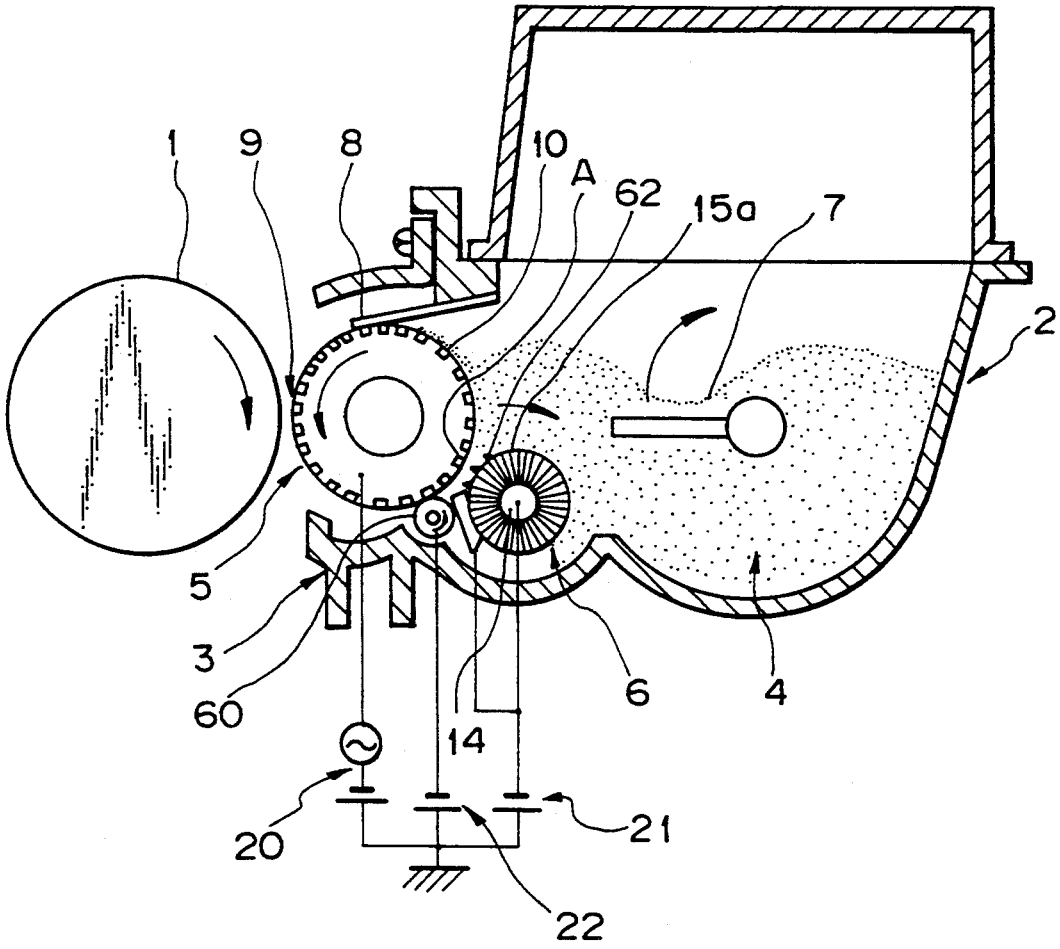

Referring to FIG. 16, the alternative embodiment also includes the charge roller 60 serving as charging means, and the power source 22 which applies a predetermined voltage to the roller 60. In the embodiment, the toner supply roller 6 is implemented as a fur brush having a metallic core 14 and fibers implanted thereon to form a fur brush 15*a*. The roller or fur brush 6 is spaced apart from the developing roller 5 by a predetermined distance and driven in a predetermined direction. A conductive screen 62 is located such that the brush 15*a* bites into the screen 62 by a predetermined amount at the side where the rollers 5 and 6 face each other. A predetermined voltage is applied to the conductive screen 62. The rest of the construction is identical with the previous embodiments, and a detailed description will not be made to avoid redundancy.

In operation, on completing development, the developing roller 5 is rotated in a direction indicated by an arrow in the figure (at a speed of about 120 mm/sec which is substantially the same as that of the drum 1) until it contacts the charge roller 60. The charge roller 60 not only removes the toner remaining on the roller 5 but also charges the dielectric portions 52 to a polarity opposite to that of the toner. Since the conductive portions 51 adjoin the dielectric portions 52 and are connected to ground, a charge opposite in polarity to the portions 52 is induced in the portions 51. As a result, microfields containing intense vertical and horizontal components are formed at the boundaries between the two portions 51 and 52 (see FIGS. 4A and 4B). As such part of the surface of the roller 5 is brought to a position where it faces the roller 6, a potential of the same polarity as the toner is deposited on the conductive screen 62. As a result, electric fields perpendicular to the conductive portions 51 of the roller 5 are formed. Consequently, the microfields ascribable to the dielectric portions 52 and the electric fields between the rollers 5 and 6 exist together (see FIG. 1).

The roller 6 in rotation conveys the toner to the position where it faces the roller 5. At the same time, the toner removed from the brush 15*a* of the roller 6 by the screen 62 is fed to such a position. The toner is charged by the friction thereof with the fur brush 15*a* and then brought into contact with the screen 62 to be further charged. The toner caught by the microfields at the edges of the dielectric portions 52 is intensely held on the roller 5. Also, the charged toner deposits on the conductive portions 51 of the roller 5. In this manner, the microfields on the roller 5 and the fields ascribable to the potential difference between the roller and the screen are combined to cause the toner to form multiple layers stably on the roller 5. Hence, although part of the toner on the roller 5 is consumed by development, the initial toner deposition is recovered by a single toner supply step.

Although the toner also deposits on the dielectric portions 52, the amount of deposition simply matches the frictional charge deposited on the portions 52. Hence, a greater amount of toner deposits on the conductive portions 51 due to the mirror charge of the charged toner.

As the roller 5 is further rotated, the blade 8 levels the toner on the roller 5 to form uniform toner layers. Since the toner caught by the microfields at the edges of the dielectric surfaces are intensely held on the roller 5, the multiple toner layers are not disturbed despite a scavenging force which will be exerted by the blade 8. In the position where the rollers 5 and 6 contact, the roller 6 is moved in the same direction as the roller 5 and at a speed about 1 to 2 times as high as the speed of the roller 5. As a result, the toner is electrostatically deposited on the roller 5 in an amount of 1.5 mg/cm$^2$ to 2.0 mg/cm$^2$ and with a charge of 8 μc/g to 15 μc/g. The multiple toner layers are sufficiently thin for development. The toner regulated by the blade 8 reaches the developing region 9. In the developing region, noncontact N/P development was effected with the photoconductive element and roller 5 moved at the same speed and with a bias promoting the flight of the toner applied. The resulting images were free from background contamination and rendered solid portions and lines clear-cut.

A specific example of the illustrative embodiment will be described hereinafter.

EXAMPLE 10

(1) Conductive screen 62: The screen 62 was made of SUS and had a diameter of 0.5 mm. The gap between the screen 62 and the roller 5 was 1 mm. Four such screens 62 were arranged at a distance of 1.5 mm. An AC bias having a peak-to-peak voltage of 1000 V and a frequency of 1000 Hz and on which DC −1500 V (or a DC bias of −1800 V) was superposed was applied to the screens 62.

(2) Toner supply roller 6: Fibers of carbon black-containing acryl polymer (SA-7 available from Toray) were implanted on the roller 6 and caused to bite into the screen 62 by 1 mm. The brush had a volume resistivity of about $10^3$ Ωcm to $10^5$ Ωcm and a density of 30,000 to 70,000 fibers/inch. A bias of the same potential as the screen 62 was applied from the power source 21 to the roller 6.

The rest of the conditions was the same as in Example 9.

Figure 17:
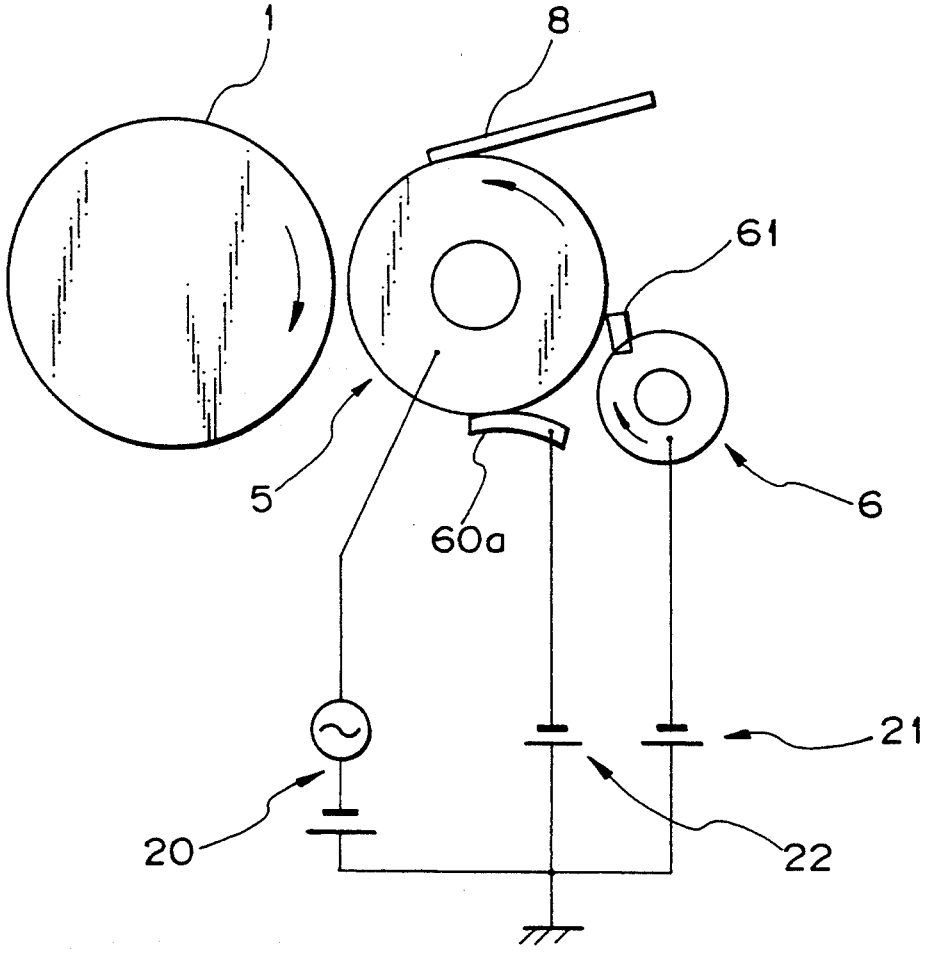

In the embodiments shown in FIGS. 15 and 16, the charge roller 60 is used to charge the dielectric portions 52 of the roller 5 and to initialize the roller 5 by removing the remaining toner. Alternatively, as shown in FIG. 17, the charging and initializing member may be constituted by a charge blade 60*a*. Preferably, the charge blade 60*a* contacts the roller 5 in the illustrated manner. To efficiently charge the dielectric portions 52 of the roller 5, the charge blade 60*a* should advantageously have a low resistance, preferably $10^6$ Ωcm or below. The charge blade 60*a* may be made of a mixture of 100 parts of polyester urethane rubber and 30 parts of carbon black.

While the embodiments of FIGS. 15–17 have concentrated on the N/P development using a negatively charged photoconductive element, they are, of course, practicable with no regard to general conditions including the polarity and the kind of development.

Another embodiment of the present invention will be described which is also capable of forming toner layers carrying a desired charge and containing a minimum of inversely charged toner and uncharged toner.

Figure 18A:
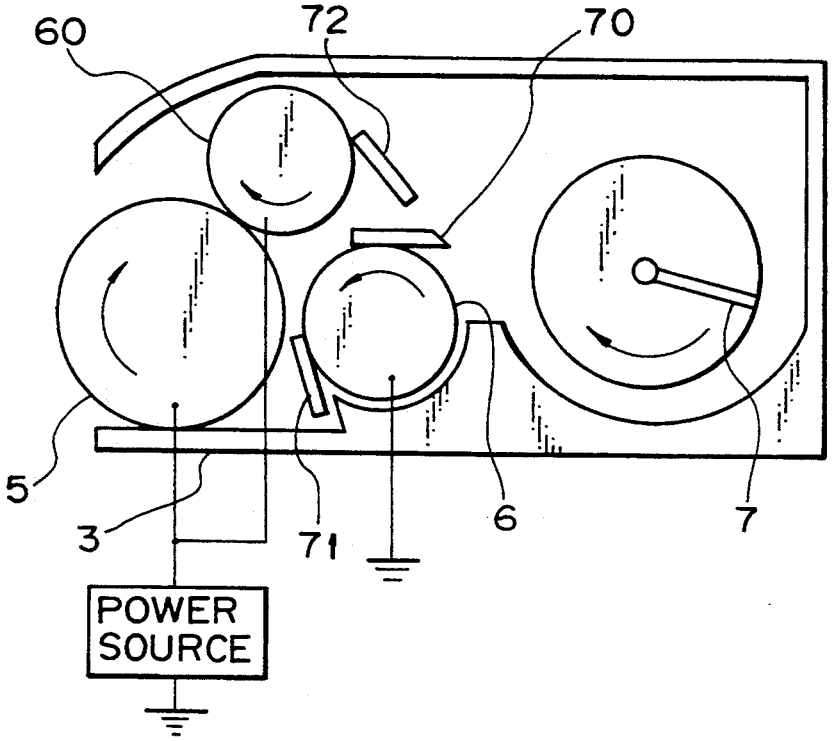
FIG. 18A is a section showing a further alternative embodiment of the present invention.
Figure 18B:
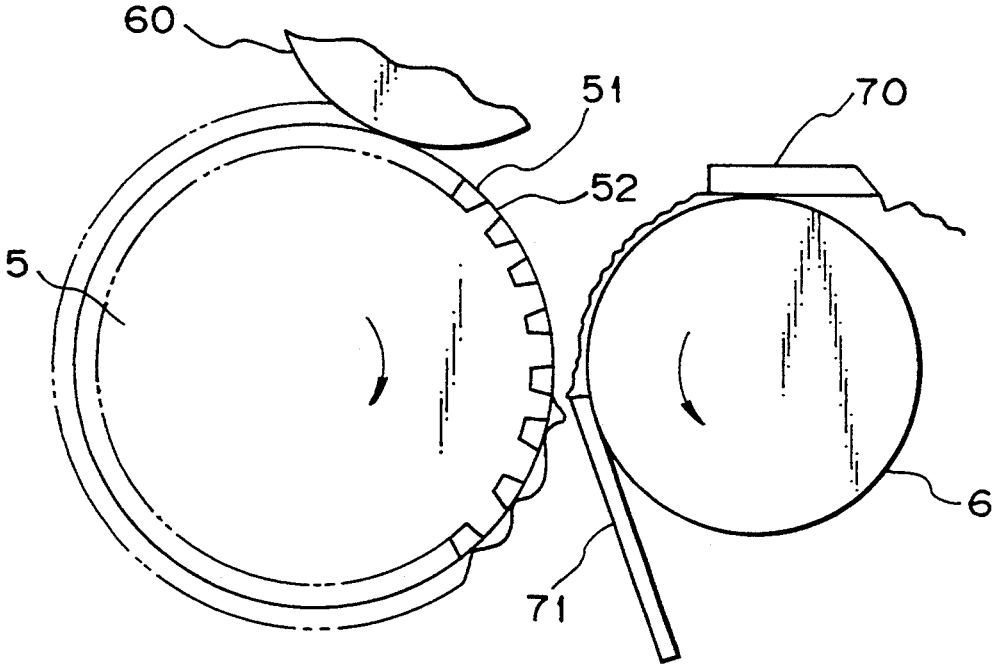
FIG. 18B is a fragmentary enlarged view of the embodiment shown in FIG. 18A.

Referring to FIGS. 18A and 18B, the alternative embodiment also has the casing 3 having an opening which faces the surface of a photoconductive element. The developer carrier implemented as the developing roller 5 is disposed in the casing 3 and rotatable counterclockwise, as viewed in the figure, at a predetermined peripheral speed while partly showing itself through the opening of the casing 3. The toner supply roller, or developer supplying means, 6 adjoins the developing roller 5 at the right-hand side of the roller 5 and rotatable counterclockwise, as viewed in the figure. The nonmagnetic toner is stored in the hopper or developer storing means which is contiguous with the right end of the casing 3. The agitator 7 supplies the toner from the hopper to the toner supply roller 6 while agitating it. The charge roller or charging member is located upstream of the toner supply roller 6 with respect to the direction of rotation of the roller 5 and rotatable clockwise in contact with the roller 5.

The developing roller 5 may be spaced apart from the photoconductive element by a predetermined gap to effect noncontact development. Alternatively, as shown in FIG. 6 or 7, the toner layer on the developing roller 5 may contact the photoconductive element to effect contact development. In any case, to prevent the local increase in image density, the developing roller 5 is rotated such that in the developing region the surface of the roller 5 moves in the same direction as the photoconductive element and at substantially the same peripheral speed as the element. Specifically, in the case of contact development, if the roller 5 and photoconductive element move at exactly the same peripheral speed, the toner is physically apt to deposit on the photoconductive element with no regard to the surface potential of the element. To eliminate this, the peripheral speed of the roller 5 is selected to be slightly higher than that of the photoconductive element. For example, it is preferable that the ratio of the peripheral speed of the photoconductive element to that of the roller 5 be 1:1.05 to 1:1.1. Such a ratio makes the above-mentioned local increase in image density inconspicuous.

A suitable bias voltage for development, e.g., DC, AC, DC-superposed AC or pulse voltage is applied to the developing roller 5. Particularly, for noncontact development, it is preferable to apply a voltage having an alternating component which promotes efficient flight of the toner (e.g. AC, DC-superposed AC or pulse voltage). The roller 5 may be provided with a structure shown in FIGS. 3A and 3B or 8A and 8B.

The toner supply roller 6 is constituted by a roller having a sponge layer for holding the toner inside the surface thereof, e.g., a carbon-containing foam polyurethane sponge roller whose volume resistivity is about $1\times10^6$ Ωcm. Alternatively, use may be made of a fur brush roller having a great number of fibers implanted thereon.

Since the gap between the rollers 5 and 6 and the linear velocity ratio of the rollers 5 and 6 effect the amount of toner to be supplied to the roller 5, they are so set as to insure a desired amount of toner deposition on the roller 5. Generally, the amount of toner deposition on the roller 5 optimum for development is considered to be 0.8 mg/cm$^2$ to 1.0 mg/cm$^2$ for contact development or to be, in relation to the toner transfer ratio, 1.2 mg/cm$^2$ to 1.5 mg/cm$^2$ for noncontact development. Assume that the rollers 5 and 6 are spaced apart by 100 μm. Then, to achieve the optimum amount of toner deposition, it is preferable that the linear velocity ratio of the roller 6 to the roller 5 be 1.0 to 1.2 for contact development or 1.5 to 2.0 for noncontact development. The distance between the rollers 5 and 6 should preferably range from 100 μm to 150 μm to promote the transfer of the toner from the roller 6 to the roller 5.

A charge blade 70 serves as the charging means and is held in pressing contact with the toner supply roller 6. A counter blade 71 contacts part of the surface of the roller 6 facing the roller 5 at the edge thereof. The counter blade 71 scrapes off the toner from the roller 6 and causes it to fly toward the roller 5. When the roller 6 is implemented as a fur brush roller, the counter blade 71 will be replaced with a flicker member.

A predetermined voltage may be applied to the roller 6 for forming electric fields which promote the transfer of the toner from the roller 6 to the roller 5. Alternatively, the roller 6 may be connected to ground, as shown in FIG. 18A.

The agitator 7 supplies the toner from the hopper to the surface of the toner supply roller 6 while agitating it, as stated earlier. However, the agitator 7 is omissible if the toner can be fed to the roller 6 by gravity due to the configuration of the hopper and the fluidity of the toner.

As part of the surface of the roller 5 returns to the casing 3 by way of the position where it faces the photoconductive element, the charge roller 60 rubs such part of the roller 5 to remove the remaining toner for thereby initializing the roller 5. At the same time, the charge roller 60 frictionally charges the surface of the roller 5 to form a great number of microfields, as labeled E in FIG. 3B. At least the surface of the charge roller 60 is made of a material capable of exhibiting such a cleaning function and a frictional charging function, e.g., carbon-containing foam polyurethane sponge whose volume resistivity is about $1\times10^6$ Ωcm. The linear velocity of the charge roller 60 may be equal to the linear velocity of the roller 5 by way of example (although the moving direction in the contact position is opposite). Further, as shown in FIG. 18A, the same voltage as one applied to the roller 5 may be applied to the charge roller 60.

In operation, the agitator 7 supplies the toner from the hopper to the toner supply roller 6. The toner on the roller 6 is deposited in the micropores and on the surface of the sponge or brush. Rotating counterclockwise, the roller 6 transports the toner to the position where it contacts the charge blade 70. At this position, the toner is frictionally charged to a predetermined polarity by the charge blade 70 to form thin layers on the roller 6. The toner layers are electrostatically restricted by a counter charge deposited on the roller 6 and are transferred to the position where the rollers 5 and 6 face.

Part of the surface of the roller 5 sequentially moved away from the developing region where it faces the photoconductive element and the position where it contacts the charge roller 60 also enters the position where the rollers 5 and 6 face each other. On contacting the charge roller 60, the roller 5 is rubbed by the roller 60 to have the toner remaining thereon removed mechanically and electrically while being charged by friction to form microfields. It is to be noted that the toner removed from the roller 5 and then deposited on the charge roller 3 is scraped off by the counter blade 72 to be reused.

In the illustrative embodiment, the toner remaining on the roller 5 moved away from the developing region is removed by the charge roller 60 and then returned to the agitator 7 by the counter blade 72, as stated above. Only the toner moved away from the position where the roller 6 and blade 70 contact and held on the roller 6 may enter the position where the rollers 5 and 6 contact, depending on the rotation of the roller 6. As a result, at the position where the rollers 5 and 6 face, the toner on the roller 6 faces the surface of the roller 5 while being spaced apart by a predetermined gap.

At the position where the rollers 5 and 6 face, the toner layers on the roller 6 are mechanically removed by the counter blade 71. As a result, the charged toner is released from the counter charge on the roller 6 and allowed to fly toward the microfields on the roller 5. The microfields electrostatically attract the toner to cause it to form thin multiple toner layers on the roller 5. At this instant, only part of the toner on which a charge of 5 $\mu c/g$ to 7 $\mu c/g$ is deposited flies, i.e., the toner with short charges and inversely charged toner do not fly. This effect is achievable despite that the roller for charging is connected to ground. The roller 5 carrying the multiple layers of sufficiently charged toner thereon rotates to transport them to the developing region where it faces the photoconductive element.

In the developing region, the surface of the roller 5 applied with a bias optimal for contact or noncontact development and the surface of the photoconductive element move at substantially the same speed. In this region, the conductive portions 51 of the roller 5 exhibit the electrode effect to form electric fields which facilitate the transfer of the toner to the photoconductive element. Part of the surface of the roller 5 developed a latent image is brought into contact with the charge roller 60 to be cleaned or initialized thereby while being charged by friction.

As stated above, in the illustrative embodiment, in the position where the rollers 5 and 6 face, the charged toner forming toner layers on the roller 6 is caused to fly toward the microfields formed on the roller 5. The microfields electrostatically attract the toner and causes it to form thin multiple layers on the roller 5. Hence, a sufficient amount of toner can be held on the roller 5 and transported to the developing region. Specifically, while the toner deposited on the roller 5 carries a charge of 5 $\mu c/g$ to 7 $\mu c/g$, the toner of short charge and inversely charged toner do not deposit. As a result, the toner layers to reach the developing region do not contain the toner of short charge or the inversely charged toner, eliminating background contamination and other undesirable occurrences. The toner layers formed on the roller 5 by flight are thin and, thereof, have a relatively level surface. This makes it possible to omit a blade heretofore held in contact with the roller 5 for regulating the thickness of the toner. The toner layers desirably formed on the roller 5 render the system stable and enhance image quality.

Specific example of this embodiment are as follows.

EXAMPLE 11

A negatively chargeable toner and an OPC drum were used to effect noncontact development. The developing roller 5 was produced by knurling the previously mentioned conductive roller and filling the resulting grooves with a dielectric material (silicone resin SR2115 available from Toray). The dielectric portions and the conductive portions of the roller 5 each occupied 50% of the entire surface of the roller 5. The toner supply roller 6 and charge roller 60 were each implemented as a sponge roller formed of carbon-containing foam polyurethane having a volume resistivity of about $1\times10^6$ Ωcm. To effect noncontact development, the linear speed ratio of the roller 6 to the roller 5 was selected to be 1:2. As a result, a toner was deposited on the roller 5 in thin multiple layers in an amount of 1.4 $gm/cm^2$ and with a charge of 7 $\mu c/g$. The other conditions are the same as those stated in the embodiment. Equispeed development was executed with a bias of DC 700 V on which AC 1000 V having a frequency of 500 Hz was superposed. The resulting image had sharpness and, regarding a solid image, a uniform density distribution.

EXAMPLE 12

A positively chargeable toner and an OPC drum were used to effect contact development. The developing roller 5 had a surface layer constituted by conductive rubber having a volume resistivity of $1\times10^4$ Ωcm and in which a fluoric resin having diameters of 50 μm to 100 μm was uniformly dispersed. The conductive portions and the dielectric portions of the roller 5 each occupied 50% of the entire surface of the roller 5. The toner supply roller 6 and charge roller 60 were each implemented as a sponge roller made of carbon-containing foam polyurethane whose volume resistivity was about $1\times10^6$ Ωcm. To effect contact development, the linear velocity ratio of the roller 6 to the roller 5 was selected to be 1:1. The toner was found deposited on the roller 5 in an amount of 0.8 $mg/cm^2$. A DC bias was applied as a bias for development, and equispeed development was executed. The resulting image also had sharpness and, regarding a solid image, a uniform density distribution.

In summary, it will be seen that the present invention provides a developing device which provides an image with desirable quality free from background contamination and low resolution by preventing uncharged and inversely charged particles of a single component developer from reaching a developing region. Further, in the device of the invention, the uncharged particles whose amount of deposition is susceptible to the environment sparingly deposit on an image carrier, i.e., only sufficiently charged toner particles deposit on the image carrier in a sufficient amount. This is successful in providing a solid image with a uniform density distribution.

Various modifications will become possible for those skilled in the art after receiving the teachings of the present disclosure without departing from the scope thereof.

What is claimed is:

1. A developing device for developing a latent image electrostatically formed on an image carrier by a developer constituted by a single component, comprising:

a developer carrier for selectively holding a charge on a surface thereof to form a great number of microfields to thereby carry the developer and supply said developer to the image carrier; and developer supplying means for frictionally charging the developer to cause said developer to deposit on said developer carrier;

said developer supplying means comprising:

charging means for selectively charging said surface of said developer carrier to thereby form said microfields;

electrode means applied with a predetermined potential and facing said surface of said developer carrier while being spaced apart from said surface by a gap sufficient to maintain said microfields, said electrode means forming around said microfields electric fields which exert an electrostatic force on the frictionally charged developer toward said surface of said developer carrier; and transporting means for transporting the frictionally charged developer to said surface of said developer carrier on which said electric fields and said microfields are formed.

2. A device as claimed in claim 1, wherein fine conductive portions and fine dielectric portions are distributed on said surface of said developer carrier.

3. A device as claimed in claim 2, wherein said developer carrier is produced by knurling a surface of a metallic roller to form predetermined grooves, coating the knurled surface of said metallic roller with a dielectric material, and then machining said knurled surface.

4. A device as claimed in claim 2, wherein said developer carrier comprises a conductive member constituting said conductive portions, and dielectric particles constituting said dielectric portions and distributed on said conductive member, said dielectric particles having particles sizes of 50 μm to 500 μm.

5. A device as claimed in claim 4, wherein said surface of said developer carrier has a hardness of 70 degrees to 100 degrees, said conductive member being connected to ground.

6. A device as claimed in claim 2, wherein said developer carrier comprises a conductive elastomer constituting said conductive portions, and dielectric particles constituting said dielectric portions and dispersed in said conductive elastomer.

7. A device as claimed in claim 2, wherein said transporting means comprises a rotary body rotatable at a position where said transporting means contacts said surface of said developer carrier;

said charging means comprising a surface portion of said rotary body made of a material capable of charging said dielectric portions to a predetermined polarity by friction;

said electrode means comprising inner periphery of a great number of micropores formed in a surface of said rotary body which are made of a conductive material and held at a predetermined potential which causes a potential difference for generating said electric fields exerting said electrostatic force when said electrode means faces said conductive portions to occur between said electrode means and said conductive portions.

8. A device as claimed in claim 2, wherein said dielectric portions and said conductive portions are connected to ground and are distributed regularly or irregularly on said surface of said developer carrier.

9. A device as claimed in claim 8, wherein said transporting means comprises a rotary body rotatable at a position where said transporting means contacts said surface of said developer carrier;

said charging means comprising a surface portion of said rotary body made of a material capable of charging said dielectric portions to a predetermined polarity by friction;

said electrode means comprising inner periphery of a great number of micropores formed in a surface of said rotary body which are made of a conductive material and held at a predetermined potential which causes a potential difference for generating said electric fields exerting said electrostatic force when said electrode means faces said conductive portions to occur between said electrode means and said conductive portions.

10. A device as claimed in claim 9, wherein said micropores constituting said electrode means have a diameter which is at least twice as great as a maximum pitch of said dielectric portions.

11. A device as claimed in claim 9, wherein said dielectric portions comprise dielectric particles irregularly distributed on said surface of said developer carrier.

12. A device as claimed in claim 11, wherein said micropores have a diameter at least twice as great as a diameter of said dielectric particles.

13. A device as claimed in claim 11, wherein said micropores have a diameter at least twice as great as a mean distance between said dielectric particles.

14. A device as claimed in claim 9, wherein said developer carrier is configured such that said dielectric portions occupy 30% to 50% of a total area of said dielectric portions and said conductive portions.

15. A device as claimed in claim 9, wherein said developer carrier has an electric resistance which is at least $1\times10^{12}$ Ωcm in said dielectric portions or less than $1\times10^{9}$ Ωcm in said conductive portions in all possible environments.

16. A device as claimed in claim 9, wherein part of a conductive base constituting said conductive portions and connected to ground and part of a dielectric material constituting said dielectric portions appear on the surface of said developer carrier such that said dielectric portions each has a width or a size lying in a range of from 50 μm to 500 μm.

17. A device as claimed in claim 9, wherein part of a conductive base constituting said conductive portions and part of fine dielectric bodies constituting said dielectric portions and being 50 μm to 200 μm deep in a direction perpendicular to said surface of said developer carrier appear together on said surface of said developer carrier.

18. A device as claimed in claim 9, wherein said developer carrier has a surface roughness (Rz) which is 3 μm to 20 μm.

19. A device as claimed in claim 1, wherein said charging means comprises a sponge member having a predetermined frictional charging characteristic and rotatable at a particular peripheral speed different from a peripheral speed of said surface of said developer carrier at a position where said sponge member contacts said surface of said developer carrier.

20. A device as claimed in claim 19, wherein said electrode means comprises a conductive sponge member applied with a predetermined voltage and rotatable at a position adjoining said surface of said developer carrier; and said transporting means comprising said conductive sponge member, and a scraper member contacting a surface of said conductive sponge member at a position where said scraper member faces said developer carrier, thereby charging the developer on said conductive sponge member while removing said developer toward said position.

21. A device as claimed in claim 20, wherein a voltage is applied to a member constituting said charging means such that a potential difference for transferring the developer from said developer carrier toward said member is generated between said member and said developer carrier.

22. A device as claimed in claim 19, wherein said electrode means comprises a conductive screen member adjoining the surface of said developer carrier and applied with a predetermined voltage; and said transporting means comprising said conductive screen member, and a rotary brush member rotatable at a position where said rotary brush member contacts said conductive screen member and being made of a material capable of frictionally charging the developer to a predetermined polarity.

23. A device as claimed in claim 22, wherein a voltage is applied to a member constituting said charging means such that a potential difference for transferring the developer from said developer carrier toward said member is generated between said member and said developer carrier.

24. A device as claimed in claim 1, wherein said charging means comprises a blade member held in contact with said surface of said developer carrier and having a predetermined frictional charging characteristic.

25. A device as claimed in claim 24, wherein said electrode means comprises a conductive sponge member applied with a predetermined voltage and rotatable at a position adjoining said surface of said developer carrier; and said transporting means comprising said conductive sponge member, and a scraper member contacting a surface of said conductive sponge member at a position where said scraper member faces said developer carrier, thereby charging the developer on said conductive sponge member while removing said developer toward said position.

26. A device as claimed in claim 25, wherein a voltage is applied to a member constituting said charging means such that a potential difference for transferring the developer from said developer carrier toward said member is developed between said member and said developer carrier.

27. A device as claimed in claim 24, wherein said electrode means comprises a conductive screen member adjoining said surface of said developer carrier and applied with a predetermined voltage; and said transporting means comprising said conductive screen member, and a rotary brush member rotatable at a position where said rotary brush member contacts said conductive screen member and being made of a material capable of frictionally charging the developer to a predetermined polarity.

28. A device as claimed in claim 27, wherein a voltage is applied to a member constituting said charging means such that a potential difference for transferring the developer from said developer carrier toward said member is developed between said member and said developer carrier.

29. A developing device comprising:

a developer carrier having fine conductive portions and fine dielectric portions connected to ground regularly or irregularly distributed on a surface thereof for carrying a developer on said surface and transporting said developer to a position where said developer carrier faces an image carrier;

a charging member for forming a great number of microfields on said surface of said developer carrier in frictional contact with said surface;

a developer supplying member facing said surface of said developer carrier while being spaced apart by a predetermined gap for supplying the developer to said surface where said microfields are formed; and charging means for charging the developer deposited on said developer supplying member.

30. A device as claimed in claim 29, wherein said gap lies in a range of from 100 $\mu$m to 150 $\mu$m.

31. A developing device for developing an electrostatic latent image by a developer constituted by a single component, comprising:

a developer carrier having fine dielectric portions and fine conductive portions connected to ground regularly or irregularly distributed on a surface thereof;

storing means for storing the developer;

transporting means for transporting the developer from said storing means to said surface of said developer carrier;

frictional charging means for charging the developer by friction;

charging means for depositing a predetermined charge on said dielectric portions for forming microfields on said surface of said developer carrier;

a rotary body having a predetermined resistance and rotatable at a position where said rotary body contacts said surface of said developer carrier, said rotary body being formed with a great number of micropores in a surface thereof whose depth does not disturb said microfields even when facing said surface of said developer carrier; and power supply means for setting up a potential difference between said rotary body and said conductive portions to thereby generate electric fields which exert on the frictionally charged developer an electrostatic force directed from said rotary body toward said surface of said developer carrier;

wherein one of said conductive portions and said rotary body is semiconductive while the other of said conductive portions and said rotary body is conductive, the developer having an intrinsic volume resistivity which prevents dielectric breakdown from occurring despite said electric fields generated by said power supply means.

32. A device as claimed in claim 31, wherein said potential difference is not greater than 200 V, said one of said conductive portions and said rotary body having an electric resistance of at least $1\times10^6$ $\Omega$cm and less than $10^9$ Ωcm, said other of said conductive portions and said rotary body having an electric resistance of $1\times10^6$ Ωcm or below, the single component type developer having an intrinsic volume resistivity of at least $1\times10^{13}$ Ωcm.

33. A developing device for developing an electrostatic latent image by a developer constituted by a single component, comprising:

a developer carrier having fine dielectric portions and fine conductive portions connected to ground regularly or irregularly distributed on a surface thereof;

storing means for storing the developer;

transporting means for transporting the developer from said storing means to said surface of said developer carrier;

frictional charging means for charging the developer by friction;

charging means for depositing a predetermined charge on said dielectric portions for forming microfields on said surface of said developer carrier;

a rotary body having a predetermined resistance and rotatable at a position where said rotary body contacts the surface of said developer carrier, said rotary body being formed with a great number of micropores in a surface thereof whose depth does not disturb said microfields even when facing said surface of said developer carrier; and power supply means for setting up a potential difference between said rotary body and said conductive portions to thereby generate electric fields which exert on the frictionally charged developer an electrostatic force directed from said rotary body toward said surface of said developer carrier;

wherein at least a surface of said rotary body is made of a material intermediate between materials constituting said dielectric portions and the developer with respect to a frictional charge sequence, said charging means and said frictional charging means being constituted by said surface of said rotary body.

34. A developing device for developing an electrostatic latent image by a developer constituted by a single component, comprising:

a developer carrier having fine dielectric portions and fine conductive portions connected to ground regularly or irregularly distributed on a surface thereof;

storing means for storing the developer;

transporting means for transporting the developer from said storing means to said surface of said developer carrier;

frictional charging means for charging the developer by friction;

charging means for depositing a predetermined charge on said dielectric portions for forming microfields on said surface of said developer carrier;

a rotary body having a predetermined resistance and rotatable at a position where said rotary body contacts said surface of said developer carrier, said rotary body being formed with a great number of micropores in a surface thereof whose depth does not disturb said microfields even when facing said surface of said developer carrier; and power supply means for setting up a potential difference between said rotary body and said conductive portions to thereby generate electric fields which exert on the frictionally charged developer an electrostatic force directed from said rotary body toward said surface of said developer carrier;

wherein said charging means and said frictional charging means deposit charges of the same polarity.

35. A developing device for developing an electrostatic latent image by a developer constituted by a single component, comprising:

a developer carrier having fine dielectric portions and fine conductive portions connected to ground regularly or irregularly distributed on a surface thereof;

storing means for storing the developer;

transporting means for transporting the developer from said storing means to said surface of said developer carrier;

frictional charging means for charging the developer by friction;

charging means for depositing a predetermined charge on said dielectric portions for forming microfields on said surface of said developer carrier;

a rotary body having a predetermined resistance and rotatable at a position where said rotary body contacts the surface of said developer carrier, said rotary body being formed with a great number of micropores in a surface thereof whose depth does not disturb said microfields even when facing said surface of said developer carrier; and power supply means for setting up a potential difference between said rotary body and said conductive portions to thereby generate electric fields which exert on the frictionally charged developer an electrostatic force directed from said rotary body toward said surface of said developer carrier;

wherein said conductive portions have a volume resistivity of $10^6$ Ωcm or below, said charging means and said frictional charging means deposit charges of the same polarity.

36. A developing device for developing an electrostatic latent image by a developer constituted by a single component, comprising:

a developer carrier having fine dielectric portions and fine conductive portions connected to ground regularly or irregularly distributed on a surface thereof;

storing means for storing the developer;

transporting means for transporting the developer from said storing means to said surface of said developer carrier;

frictional charging means for charging the developer by friction;

charging means for depositing a predetermined charge on said dielectric portions for forming microfields on said surface of said developer carrier;

a rotary body having a predetermined resistance and rotatable at a position where said rotary body contacts said surface of said developer carrier, said rotary body being formed with a great number of micropores in a surface thereof whose depth does not disturb said microfields even when facing said surface of said developer carrier; and power supply means for setting up a potential difference between said rotary body and said conductive portions to thereby generate electric fields which exert on the frictionally charged developer an electrostatic force directed from said rotary body toward said surface of said developer carrier;

wherein said conductive portions have a volume resistivity of $10^6$ Ωcm or below, said charging means depositing on said dielectric portions and said conductive portions a charge of a polarity opposite to a polarity to which said frictional charging means frictionally charges the developer.

37. A device as claimed in claim 36, wherein said conductive portions are made of a material produced by mixing carbon or similar conduction agent in the same material as said dielectric portions whose volume resistivity is at least $10^{13}$ Ωcm to thereby reduce the volume resistivity to $10^8$ Ωcm or below.

38. A developing device for developing an electrostatic latent image by a developer constituted by a single component, comprising:

a developer carrier having fine dielectric portions and fine conductive portions connected to ground regularly or irregularly distributed on a surface thereof;

storing means for storing the developer;

transporting means for transporting the developer from said storing means to said surface of said developer carrier;

frictional charging means for charging the developer by friction;

charging means for depositing a predetermined charge on said dielectric portions for forming microfields on said surface of said developer carrier;

a rotary body having a predetermined resistance and rotatable at a position where said rotary body contacts the surface of said developer carrier, said rotary body being formed with a great number of micropores in a surface thereof whose depth does not disturb said microfields even when facing said surface of said developer carrier; and power supply means for setting up a potential difference between said rotary body and said conductive portions to thereby generate electric fields which exert on the frictionally charged developer an electrostatic force directed from said rotary body toward said surface of said developer carrier;

wherein the developer has a volume resistivity of less than $10^{13}$ Ωcm.

39. A developing device for developing an electrostatic latent image by a developer constituted by a single component, comprising:

a developer carrier having fine dielectric portions and fine conductive portions connected to ground regularly or irregularly distributed on a surface thereof;

storing means for storing the developer;

transporting means for transporting the developer from said storing means to said surface of said developer carrier;

frictional charging means for charging the developer by friction;

charging means for depositing a predetermined charge on said dielectric portions for forming microfields on said surface of said developer carrier;

a rotary body having a predetermined resistance and rotatable at a position where said rotary body contacts said surface of said developer carrier, said rotary body being formed with a great number of micropores in a surface thereof whose depth does not disturb said microfields even when facing said surface of said developer carrier; and power supply means for setting up a potential difference between said rotary body and said conductive portions to thereby generate electric fields which exert on the frictionally charged developer an electrostatic force directed from said rotary body toward said surface of said developer carrier;

wherein said rotary body is used as said transporting means.

40. A device as claimed in claim 39, wherein said rotary body has a surface layer made of a foam elastic material which, assuming that an apparent density is X and a product of a hardness and a number of cells is Y, has a value greater than a value at which Y satisfies an equation:

$$(40X-3Y+500)=0$$

where X is greater than or equal to 40.

41. A device as claimed in claim 40, wherein said foam elastic material is produced by dispersing a conductive material in a starting material and then causing the dispersion to foam.

42. A device as claimed in claim 39, wherein at least a surface layer of said rotary body is made of a foam elastic material such that pores open on said surface layer constitute said micropores, said surface layer of said rotary body moving in the same direction as the surface of said developer carrier at the position where said rotary body contacts said developer carrier.

43. A device as claimed in claim 42, wherein said rotary body is pressed against the surface of said developer such that said rotary body bites into said surface by 0.3 mm to 1.8 mm, said surface layer of said rotary body moving at a speed 0.5 to 2.5 times as high as a speed of said surface of said developer.

44. A device as claimed in claim 39, wherein said potential difference is a potential difference alternating between a positive and a negative polarity with the elapse of time.

45. A device as claimed in claim 39, further comprising a single bias generator connected to said developer carrier for applying AC, pulse or similar periodic bias for development to said developer carrier, wherein said transporting means is connected to said developer carrier via a capacitor or a Zener diode, a periodic bias generated by superposing a DC component of the same polarity as the charge of the developer on the potential of said developer carrier and having the same phase as the bias for development being applied to said transporting means.

* * * * *